US011976408B2

(12) United States Patent
Kim et al.

(10) Patent No.: US 11,976,408 B2
(45) Date of Patent: May 7, 2024

(54) CLOTHING TREATMENT DEVICE

(71) Applicant: LG Electronics Inc., Seoul (KR)

(72) Inventors: Kihyuk Kim, Seoul (KR); Jaeil Bae, Seoul (KR); Wookjun Chung, Seoul (KR); Jaehyung Kim, Seoul (KR); Semin Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 610 days.

(21) Appl. No.: 17/041,260

(22) PCT Filed: Apr. 3, 2019

(86) PCT No.: PCT/KR2019/003925
§ 371 (c)(1),
(2) Date: Sep. 24, 2020

(87) PCT Pub. No.: WO2019/194565
PCT Pub. Date: Oct. 10, 2019

(65) Prior Publication Data

US 2021/0054560 A1 Feb. 25, 2021

Related U.S. Application Data

(60) Provisional application No. 62/679,035, filed on Jun. 1, 2018.

(30) Foreign Application Priority Data

Apr. 3, 2018 (KR) ..... 10-2018-0038422
Jun. 28, 2018 (KR) ..... 10-2018-0074728
Apr. 2, 2019 (KR) ..... 10-2019-0038733

(51) Int. Cl.
*D06F 58/10* (2006.01)
*D06F 35/00* (2006.01)
(Continued)

(52) U.S. Cl.
CPC ..... *D06F 58/10* (2013.01); *D06F 35/00* (2013.01); *D06F 39/14* (2013.01); *D06F 58/203* (2013.01);
(Continued)

(58) Field of Classification Search
CPC ..... D06F 58/10; D06F 58/14; D06F 58/203; D06F 58/26; D06F 35/00; D06F 39/14;
(Continued)

(56) References Cited

U.S. PATENT DOCUMENTS 3,203,122 A 8/1965 Sweatt
4,611,419 A 9/1986 Duplessy et al.
(Continued)

FOREIGN PATENT DOCUMENTS

CN 1170061 1/1998
CN 1545392 11/2004
(Continued)

OTHER PUBLICATIONS

RU Notice of Allowance in Russian Appln. No. 2020133086, dated Apr. 6, 2021, 22 pages (with English translation).
(Continued)

*Primary Examiner* — Ismael Izaguirre
(74) *Attorney, Agent, or Firm* — Fish & Richardson P.C.

(57) ABSTRACT

The present invention relates to a clothing treatment device. The clothing treatment device comprises a cabinet having an open part provided at the front thereof: a door assembly for opening and closing the open part; a first clothing treatment room, which is provided inside the cabinet so as to provide a space for accommodating clothing therein, and communicates with the outside of the cabinet through the open part; and a machinery room for circulating steam or air in the first clothing treatment room, wherein the door assembly comprises; an assembly housing which opens and closes the
(Continued)

opened front surface of the cabinet and which has a space of a second clothing treatment room therein; and an assembly door for opening and closing, at the front of the cabinet, the second clothing treatment room formed in the assembly housing.

20 Claims, 21 Drawing Sheets

(51) Int. Cl.

| | |
|---|---|
| ***D06F 39/14*** | (2006.01) |
| ***D06F 58/20*** | (2006.01) |
| ***D06F 58/26*** | (2006.01) |
| ***D06F 71/34*** | (2006.01) |
| ***D06F 71/36*** | (2006.01) |
| ***D06F 73/02*** | (2006.01) |

(52) U.S. Cl.
CPC ..... *D06F 58/26* (2013.01); *D06F 71/34* (2013.01); *D06F 71/36* (2013.01); *D06F 73/02* (2013.01)

(58) Field of Classification Search
CPC ..... D06F 71/34; D06F 71/36; D06F 67/00; D06F 67/005; D06F 73/00; D06F 73/02
See application file for complete search history.

(56) References Cited

U.S. PATENT DOCUMENTS

| | | | |
|---|---|---|---|
| 4,694,146 | A | 9/1987 | DeMars |
| 5,815,961 | A | 10/1998 | Estes et al. |
| 2004/0237356 | A1 | 12/2004 | Khasianovich |
| 2010/0147040 | A1 | 6/2010 | Kim et al. |
| 2015/0020419 | A1 | 1/2015 | Park et al. |
| 2015/0159315 | A1 | 6/2015 | Lim et al. |
| 2016/0177500 | A1 | 6/2016 | Yoon et al. |

FOREIGN PATENT DOCUMENTS

| | | | | |
|---|---|---|---|---|
| CN | 104294529 | | 1/2015 | |
| CN | 105714535 | | 6/2016 | |
| CN | 105714543 | | 6/2016 | |
| CN | 107385829 | | 11/2017 | |
| EP | 0816552 | | 9/2002 | |
| EP | 2759632 | A1 * | 7/2014 | ..... D06F 58/10 |
| EP | 2826911 | | 1/2015 | |
| EP | 3034684 | A1 * | 6/2016 | ..... D06F 58/10 |
| JP | 54001527 | | 1/1979 | |
| JP | S5881098 | | 5/1983 | |
| JP | 10314500 | | 12/1998 | |
| JP | 2002166098 | | 6/2002 | |
| JP | 2005-500112 | | 1/2005 | |
| KR | 100444005 | | 11/2004 | |
| KR | 1020080001854 | | 1/2008 | |
| KR | 1020150009718 | | 1/2015 | |
| KR | 1020150065297 | | 6/2015 | |
| RU | 2576509 | | 3/2016 | |
| RU | 2015101077 | | 8/2016 | |

OTHER PUBLICATIONS

Office Action in Australian Appln. No. 2019249761, dated Jun. 10, 2022, 7 pages.
Office Action in Chinese Appln. No. 201980023774.7, dated May 7, 2022, 16 pages (with English translation).
Extended European Search Report in European Appln. No. 19781663.0, dated Jan. 11, 2022, 11 pages.
Office Action in Japanese Appln. No. 2020-553481, dated Nov. 30, 2021, 9 pages (with English translation).
Office Action in Russian Appln. No. 2021116015, dated Nov. 11, 2021, 5 pages (English translation only).
PCT International Search Report and Written Opinion in International Application No. PCT/KR2019/003925, dated Jul. 12, 2019, 12 pages (with English translation).
AU Office Action in Australian Appln. No. 2019249761, dated Jun. 17, 2021, 5 pages.
Office Action in Korean Appln. No. 10-2019-0038733, mailed on Mar. 19, 2024, 12 pages with English translation.

* cited by examiner (a)

(b)

(a)

(b)

CLOTHING TREATMENT DEVICE

CROSS-REFERENCE TO RELATED APPLICATIONS

This application is a National Stage application under 35 U.S.C. § 371 of International Application No. PCT/KR2019/003925, filed on Apr. 3, 2019, which claims the benefit of Korean Application No. 10-2019-0038733, filed on Apr. 2, 2019, Korean Application No. 10-2018-0074728, filed on Jun. 28, 2018, U.S. Provisional Application No. 62/679,035, filed on Jun. 1, 2018, and Korean Application No. 10-2018-0038422, filed on Apr. 3, 2018. The disclosures of the prior applications are incorporated by reference in their entirety.

TECHNICAL FIELD

The present disclosure relates to a laundry treating apparatus, and more particularly, to a laundry treating apparatus that may remove wrinkles by using steam and hot wire while separately using a laundry treating chamber inside a door assembly.

BACKGROUND ART

Generally, a laundry treating apparatus refers to an apparatus that carries out a series of processes (e.g., washing, drying, deodorization, wrinkle removal, etc.) in relation to laundry. The term "laundry treating apparatus" may comprise a washing machine for washing laundry, a dryer for drying wet laundry, a washing machine with a drying function together with a washing function, a refresher for removing odors or wrinkles out of laundry, and a steamer for removing unnecessary wrinkles of laundry.

The refresher is an apparatus for refreshing a state of laundry, and serves to dry laundry, supply fragrance to laundry, prevent static electricity from occurring in laundry, or remove wrinkles of laundry.

Meanwhile, the development trend of laundry treating apparatuses is toward a single apparatus designed to carry out all of washing, drying, deodorization, and wrinkle removal for laundry. However, the existing laundry treating apparatuses are limited in deodorizing laundry or removing wrinkles from laundry because of the use of a drum for accommodating laundry and a driver for rotating the drum.

To address the problem, a "laundry treating apparatus" comprising a steamer and a refresher is disclosed in the Korean Laid-Open Patent No. 10-2014-0184457. The laundry treating apparatus comprises a treating chamber for treating laundry through air circulation or steam, and a separate crease removal module for removing a crease by pressurizing laundry inside the treating chamber.

In the above laundry treating apparatus, the crease removal module is formed at one side of a door headed for the treating chamber formed in a cabinet. Therefore, since laundry may be hung on the crease removal module in a state that the cabinet is opened, a problem occurs in that the crease removal module cannot be used while laundry is being treated in the treating chamber inside the cabinet. That is, a problem occurs in that the treating chamber inside the cabinet and the crease removal module cannot be operated individually.

The crease removal module includes a base plate provided in a door and formed of one plate having an elastic force, supporting laundry, and a press plate rotated with the base plate by being coupled to the base plate and tightly attached to the base plate to pressurize the laundry.

If the crease removal module is used, in a state that laundry is hung, a cycle chamber located below the cabinet may supply the hot air and at the same time pressurize the laundry to perform deodorization and wrinkle removal.

In a state that laundry is unfolded inside the cabinet by self-load, the laundry treating apparatus may dry and deodorize the laundry or remove wrinkles of the laundry by supplying the hot air or moisture to the laundry. As the press plate presses the surface of the laundry, wrinkles may effectively be removed from the laundry or a crease (crease preset in laundry) may be formed on the laundry, whereby the need for ironing the laundry after washing or drying may be obviated.

In the laundry treating apparatus of the related art, however, since there is no separate member between the press plate and the base plate, only one laundry item may be pressurized, whereby a problem occurs in that efficiency is reduced.

Meanwhile, in the laundry treating apparatus of the related art, since the press plate presses a laundry item P while rotating from a side surface of the laundry item P, the laundry item P is pressed sequentially from one side surface to the other side surface thereof.

For this reason, a relatively high pressure is applied to a part of the laundry item P close to the press plate, whereas a relatively low pressure is applied to another part of the laundry item P far from the press plate. As a result, a problem occurs in that the laundry item P is not pressed uniformly.

Moreover, while the laundry item P is being pressed by the press plate, a problem occurs in that the laundry item P is deformed or displaced by the press plate.

Also, even though the laundry item P is held in the laundry treating apparatus of the related art, the laundry item P does not remain stationary, which may not be prevented from being displaced during pressing. Therefore, the laundry treating apparatus of the related art generates more creases than needed or an unintended crease on the laundry item P due to the press plate.

In addition, when a laundry item has partitioned areas like pants, the laundry treating apparatus of the related art has a problem that it cannot press the partitioned areas respectively. For example, if the laundry item is provided with bottoms like pants in the laundry treating apparatus of the related art, a first part worn on a left leg of a user and a second part worn on a right leg of the user may be pressed by being overlapped with each other.

Therefore, a problem occurs in that the first part and the second part may alternately be overlapped with each other or displaced when pressed, whereby a crease may occur in an unintended area of the laundry item.

Also, since the hot air or moisture (including steam) is not supplied to an area where the first part and the second part face each other, a problem occurs in that refresh such as drying and deodorization is not performed actively.

DISCLOSURE

Technical Problem

A first object of the present disclosure is to provide a laundry treating apparatus that may remove a crease by pressing laundry regardless of an operation in a laundry treating space inside a cabinet.

A second object of the present disclosure is to provide a laundry treating apparatus that may effectively remove a crease of laundry in a laundry treating space formed inside a door assembly provided separately from a cabinet.

A third object of the present disclosure is to provide a laundry treating apparatus that treats a plurality of laundry items for a short time to remove a crease by pressurization.

A fourth object of the present disclosure is to provide a laundry treating apparatus that may uniformly pressurize each partitioned area even though a laundry item has partitioned areas like pants.

A fifth object of the present disclosure is to provide a laundry treating apparatus that may uniformly supply at least one of steam and hot air to each partitioned area of a laundry item.

A sixth object of the present disclosure is to provide a laundry treating apparatus that may prevent a laundry item from being displaced when the laundry item is pressurized.

A seventh object of the present disclosure is to provide a laundry treating apparatus that may exactly form a crease in a user's intended area.

In addition to the objects of the present disclosure as mentioned above, additional objects and features of the present disclosure will be clearly understood by those skilled in the art from the following description of the present disclosure.

Technical Solution

To achieve the above objects, a laundry treating apparatus according to the embodiment of the present disclosure comprises a cabinet having an opening in a front direction, a door assembly opening or closing the opening, a first laundry treating chamber provided inside the cabinet to provide a space for accommodating laundry and communicated with the outside of the cabinet through the opening, and a machine chamber communicated with the first laundry treating chamber to arrange at least one of a steam supply unit supplying steam to the first laundry treating chamber and an air supply unit circulating the air, wherein the door assembly includes an assembly housing opening or closing the opened front surface of the cabinet, opening or closing the opening, and forming a second laundry treating chamber removing a crease of the laundry by applying a pressure to inside, and an assembly door opening or closing the second laundry treating chamber in a front direction of the cabinet, and thus the second laundry treating chamber is formed inside the door assembly separately the inside of the cabinet and may be opened toward the outside of the cabinet through the assembly door. That is, the second laundry treating chamber may have a door in door type.

Also, a base plate supporting the laundry arranged in the second laundry treating chamber is arranged at an inner side of any one of the assembly housing and the assembly door of the laundry treating apparatus according to the present disclosure, and a press plate tightly attached to the base plate to pressurize the laundry is arranged at an inner side of the other one of the assembly housing and the assembly door, whereby the laundry arranged in the second laundry treating chamber formed at the inner side of the door assembly may be treated.

The laundry treating apparatus may further comprise a heating unit heating the press plate to apply heat to the laundry and remove a crease. In detail, the heating unit includes a press plate electric heater supplied with electricity from an external power source to generate heat, and the press plate electric heater may be arranged at an inner side of the press plate to apply heat to the laundry and remove a crease.

The laundry treating apparatus according to the present disclosure may further comprise a cabinet hinge unit rotatably connecting the door assembly with the cabinet, an assembly hinge unit rotatably connecting the door assembly to the assembly housing, and a steam moving unit supplying steam generated from a steam generator to the second laundry treating chamber through the cabinet hinge unit and the assembly hinge unit or discharging the air of the second laundry treating chamber, whereby steam may be supplied to the second laundry treating chamber and thus the laundry may be treated.

The laundry treating apparatus of the present disclosure may further comprise a connection pipe arranged inside the door assembly to connect the cabinet hinge unit with the assembly hinge unit, whereby steam may be moved to the second laundry treating chamber.

In the laundry treating apparatus of the present disclosure, the connection pipe is inserted into an inner side of the assembly hinge unit, and is provided with a connection pipe hole opened to move steam at one side of a circumferential surface which is in contact with the assembly hinge unit, and the assembly hinge unit is provided with an assembly hinge unit hole opened to move steam at one side of a circumferential surface which is in contact with the connection pipe. The assembly hinge unit is rotated together with the assembly door to control steam supplied to the second laundry treating chamber by rotation of the assembly door.

In the laundry treating apparatus of the present disclosure, the connection pipe hole and the assembly hinge unit hole are arranged in the same direction when the assembly door closes the second laundry treating chamber, whereby steam supplied to the second laundry treating chamber may be controlled by rotation of the assembly door.

In the laundry treating apparatus of the present disclosure, the connection pipe hole and the assembly hinge unit hole are arranged in their respective directions different from each other when the assembly door opens the second laundry treating chamber, whereby steam supplied to the second laundry treating chamber may be controlled by rotation of the assembly door.

The laundry treating apparatus of the present disclosure, the cabinet hinge unit includes a first cabinet hinge unit arranged at an upper end of the door assembly, and a second cabinet hinge unit arranged at a lower end of the door assembly, and the assembly hinge unit includes a first assembly hinge unit arranged at an upper portion of the assembly door and a second assembly hinge unit arranged at a lower portion of the assembly door. The steam moving unit includes a steam supply unit supplying steam generated from the steam generator to the second laundry treating chamber through the first cabinet hinge unit and the first assembly hinge unit, and a steam discharge unit discharging the air inside the second laundry treating chamber to the first laundry treating chamber through the second cabinet hinge unit and the second assembly hinge unit, whereby steam may be supplied and discharged into the second laundry treating chamber to treat the laundry.

The laundry treating apparatus of the present disclosure may further comprise a partition plate arranged between the assembly housing and the assembly door, pressurizing a pressure to each of a laundry item hung on the assembly housing and a laundry item hung on the assembly door, whereby a plurality of laundry items may be treated in the second laundry treating chamber.

The partition plate includes a fixing protrusion fixing the partition plate to one side of the assembly housing or the assembly door or releasing such fixture, whereby a plurality of laundry items may be treated in the second laundry treating chamber.

Also, a spaced distance from the assembly housing to the partition plate and a spaced distance from the partition plate to the assembly door are maintained at a certain interval when the assembly housing is fixed to the assembly door, a plurality of laundry items arranged in the second laundry treating chamber may be treated.

In detail, a first fixing member fixing laundry and a first base plate tightly attached to the partition plate to pressurize the laundry fixed to the first fixing member are arranged at an inner side of the assembly housing, and a second fixing member fixing laundry and a second base plate tightly attached to the partition plate to pressurize the laundry fixed to the second fixing member are arranged at an inner side of the assembly door, whereby a plurality of laundry items may be hung in the door assembly.

In another embodiment of the present disclosure, the door assembly further includes a support body supporting the laundry, a pressurizing body rotatably provided toward the support body to pressurize the laundry, and an ironing partition unit rotatably provided between the support body and the pressurizing body toward the support body or the pressurizing body to pressurize the laundry at both sides.

The ironing partition unit includes an ironing partition body rotatably provided between the support body and the pressurizing body, and a heating unit provided in any one of both surfaces of the partition body to supply heat to the laundry.

Also, the heating unit includes a heating body provided to be exposed to the outside in at least any one of both surfaces of the ironing partition body, and a hot wire provided in any one of the ironing partition body and the heating body to heat the heating body.

Unlike this example, the heating unit includes a heating body provided to be exposed to the outside in at least any one of both surfaces of the ironing partition body, a supply path provided in any one of the ironing partition body and the heating body and thus supplied with steam, and a plurality of discharge holes provided to discharge the steam to the laundry by passing through the heating body.

Meanwhile, the supply path further includes at least one spray path along a height direction of the ironing partition body, and the discharge holes may be provided along a length direction of the spray path.

Particularly, the laundry treating apparatus may further comprise an auxiliary steam supply unit communicated with the steam generator of the machine chamber to discharge steam through the supply path and provided in any one of the cabinet, the machine chamber and the door assembly to generate steam. In this case, the supply path may be provided to communicate the auxiliary steam supply unit with the discharge holes.

The auxiliary steam supply unit includes an auxiliary water tank detachably provided in at least any one of the cabinet, the machine chamber and the door assembly to accommodate water, an auxiliary heater heating water of the water tank to generate steam, and a discharge outlet discharging the steam by communicating the water tank with the supply path.

Meanwhile, the ironing partition unit includes a heating body provided to be exposed to the outside in at least any one of both surfaces of the ironing partition body, a hot wire provided in any one of the ironing partition body and the heating body to heat the heating body, and a supply path provided in any one of the ironing partition body and the heating body to supply steam, and the hot wire may be provided along the outside of the supply path and thus prevented from interfering with the supply path.

Also, the door assembly may further include a connection hinge rotatably coupling the ironing partition unit with the support body, and a passage unit provided in the connection hinge to allow the hot wire or the supply path to pass therethrough.

The ironing partition unit may be provided to be communicated with the machine chamber to discharge the hot air or moisture supplied from the machine chamber.

Meanwhile, the door assembly may further include a coupling hook provided in the support body to fix the pressurizing body, and a hook coupling unit provided in the pressurizing body and fixed to the coupling hook, and may prevent the support body and the pressurizing body from being spaced part from the ironing partition unit.

The laundry treating apparatus may further comprise a hanging unit provided in at least any one of an upper portion and a lower portion of the ironing partition unit.

In this case, the hanging unit may include a hanging body rotatably provided in at least any one of the upper portion and the lower portion of the ironing partition unit to support laundry, and a fixing body coupled to the hanging body to fix the laundry.

In more detail, the hanging unit may include a first hanging unit rotatably provided at an upper portion of the pressurizing body to fix the laundry, and a second hanging unit rotatably provided at a lower portion of the pressurizing body to fix the laundry, the first hanging unit may include a first hanging body rotatably provided at the upper portion of the pressurizing body to support the laundry, and a first fixing body rotatably provided in the first hanging body to fix the laundry, and the second hanging unit may include a second hanging body rotatably provided at the lower portion of the pressurizing body to support the laundry, and a second fixing body rotatably provided in the second hanging body to fix the laundry.

Also, the second hanging body may include a first through silt into which a first part of the laundry is inserted to pass therethrough, and the second fixing body may include a second through slit into which a second part of the laundry is inserted to pass therethrough. The first hanging body may include an accommodating groove having one curved surface to allow the laundry to be partially accommodated and supported.

Meanwhile, the door assembly may further include an ironing partition unit rotatably provided between the support body and the pressurizing body, and the ironing partition unit may include a heating unit provided to supply heat to an ironing partition body and laundry.

Also, the heating unit may include a heating body provided to be exposed to the outside in at least any one of both surfaces of the ironing partition body, and a hot wire provided in any one of the ironing partition body and the heating body to heat the heating body.

Unlike this example, the heating unit may include a heating body provided to be exposed to the outside in at least any one of both surfaces of the ironing partition body, a supply path provided in any one of the ironing partition body and the heating body and thus supplied with steam, and a plurality of discharge holes provided to discharge the steam to the laundry by passing through the heating body.

The supply path may further include at least one spray path along a height direction of the ironing partition body, and the discharge holes may be provided along a length direction of the spray path.

Also, the laundry treating apparatus may further comprise an auxiliary steam supply unit provided in any one of the cabinet, the machine chamber and the door assembly to generate steam, wherein the supply path may be provided to be communicated with the auxiliary steam supply unit and the discharge holes.

When the first base plate, the partition plate and the second base plate are provided at the inner side of the assembly housing, the door assembly may further include an ironing partition unit that includes an ironing partition body rotatably provided between the base plate and the press plate and a heating unit provided in at least any one of both surfaces of the ironing partition body to supply heat to the laundry. That is, the door assembly may further include a first ironing partition unit including a first ironing partition body rotatably provided between the first base plate and the partition plate and a first heating unit provided in at least any one of both surfaces of the first ironing partition body to supply heat to the laundry, and a second ironing partition unit including a second ironing partition body rotatably provided between the partition plate and the second base plate and a second heating unit provided in at least any one of both surfaces of the second ironing partition body to supply heat to the laundry.

Also, the first heating unit may include a first heating body provided to be exposed to the outside in at least any one of both surfaces of the first ironing partition body, and a first hot wire provided in any one of the first ironing partition body and the first heating body to heat the heating body, and the second heating unit may include a second heating body provided to be exposed to the outside in at least any one of both surfaces of the second ironing partition body, and a second hot wire provided in any one of the second ironing partition body and the second heating body to heat the heating body.

The first ironing partition unit may further include a first supply path provided in any one of the first ironing partition body and the first heating body and supplied with steam, and a first discharge hole provided to discharge the steam to the laundry by passing through the first heating body, the second ironing partition unit may further include a second supply path provided in any one of the second ironing partition body and the second heating body and supplied with steam, and a second discharge hole provided to discharge the steam to the laundry by passing through the second heating body. Also, the first supply path and the second supply path further include at least one first spray path and at least one second spray path, each of which is provided along height directions of the first ironing partition body and the second ironing partition body, and the first discharge hole and the second discharge hole may be provided in a plural number along length directions of the first spray path and the second spray path.

Also, the laundry treating apparatus may further comprise an auxiliary steam supply unit provided in any one of the cabinet, the machine chamber and the door assembly to generate steam, wherein the supply path may be provided to be communicated with the auxiliary steam supply unit, the first discharge hole and the second discharge hole.

Details of the other embodiments are included in the detailed description and drawings.

Advantageous Effects

The laundry treating apparatus according to the present disclosure has one or more advantageous effects as follows.

First of all, since the second laundry treating chamber formed in the door assembly may be opened or closed regardless of the fact that the cabinet is opened or closed, laundry of the second laundry treating chamber may be treated even in the middle of operation of the first laundry treating chamber.

Secondly, the second laundry treating chamber may include a separate heating unit or additionally include a separate steam supply unit to supply heat to the second laundry treating chamber formed inside the door assembly, whereby a crease of laundry hung in the second laundry treating chamber may effectively be removed.

Thirdly, a space inside the second laundry treating chamber may be partitioned and a partition plate pressurizing laundry may be provided at both sides to treat a plurality of laundry items, whereby the plurality of laundry items may be treated within a short time.

Fourthly, the present disclosure provides a laundry treating apparatus that may uniformly pressurize laundry for each partitioned area even in the case that laundry has partitioned areas such as pants.

Fifthly, the present disclosure provides a laundry treating apparatus that may uniformly supply steam or hot air to each partition area of the laundry.

Sixthly, the present disclosure provides a laundry treating apparatus that may pressurize a plurality of laundry items once.

Seventhly, the present disclosure provides a laundry treating apparatus that may prevent a position of laundry from being changed while the laundry is being pressurized.

Eighthly, the present disclosure provides a laundry treating apparatus that may skip separate ironing after a user finishes refresh of laundry, such as drying and deodorization.

Ninthly, the present disclosure provides a laundry treating apparatus that may exactly form a crease in a user's intended area.

Tenthly, the present disclosure may remove a crease by heating and pressurizing two sets of laundry items once by heating the two sets of laundry items or more and supplying steam to the laundry items using a hot wire at the same time.

It will be appreciated by persons skilled in the art that that the effects that could be achieved with the present invention are not limited to what has been particularly described hereinabove and other advantages of the present invention will be more clearly understood from the following detailed description taken in conjunction with the accompanying drawings.

BEST MODE FOR CARRYING OUT THE INVENTION

Figure 1:
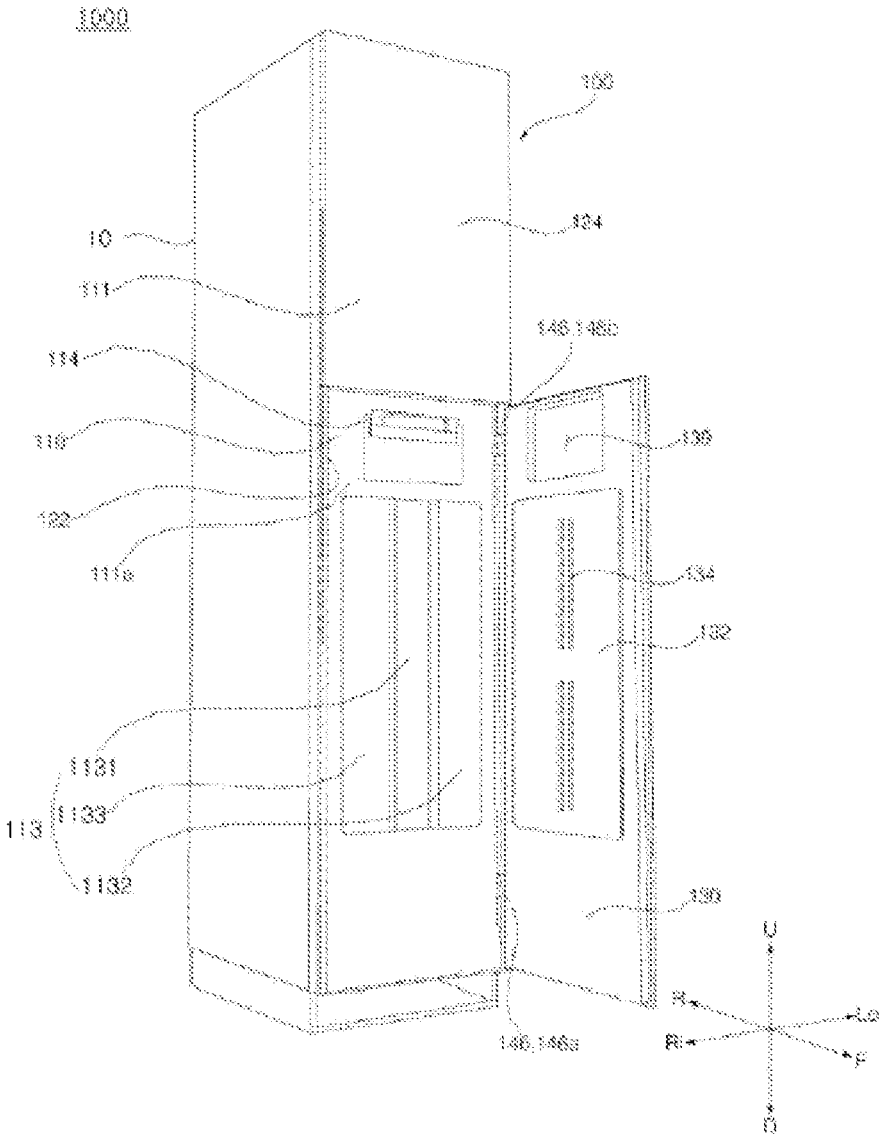
FIG. 1 illustrates the state that a door assembly of a laundry treating apparatus according to one embodiment of the present disclosure is opened.

Advantages and features of the present disclosure and methods for achieving them will be made clear from the embodiments described below in detail with reference to the accompanying drawings. The present disclosure may, however, be embodied in many different forms and should not be construed as being limited to the embodiments set forth herein. Rather, these embodiments are provided so that this disclosure will be thorough and complete, and will fully convey the scope of the invention to those skilled in the art. The present disclosure is defined only by the scope of the claims. Like reference numerals refer to like elements throughout the specification.

The terms related to directions which are used herein, for example, "front (F)/rear (R)/left (Le)/right (Ri)/upper (U) and lower (D) directions" are defined as shown to definitely understand the present disclosure, however, should be understood that the respective directions may be defined otherwise depending on references.

Also, wherever possible, the same reference numbers will be used throughout the drawings to refer to the same or like parts and their description will be replaced with the first description. The term of a singular expression in this specification should be understood to include a multiple expression as well as the singular expression if there is no specific definition in the context. Also, in description of the embodiment disclosed in this specification, if detailed description of elements or functions known in respect of the present disclosure is determined to make the subject matter of the present disclosure unnecessarily obscure, the detailed description will be omitted. Also, it is to be understood that the accompanying drawings are intended to easily understand the embodiment disclosed in this specification and technical spirits disclosed in this specification should not be restricted by the accompanying drawings.

Hereinafter, the laundry treating apparatus according to the embodiments of the present disclosure will be described with reference to the drawings.

Figure 2:
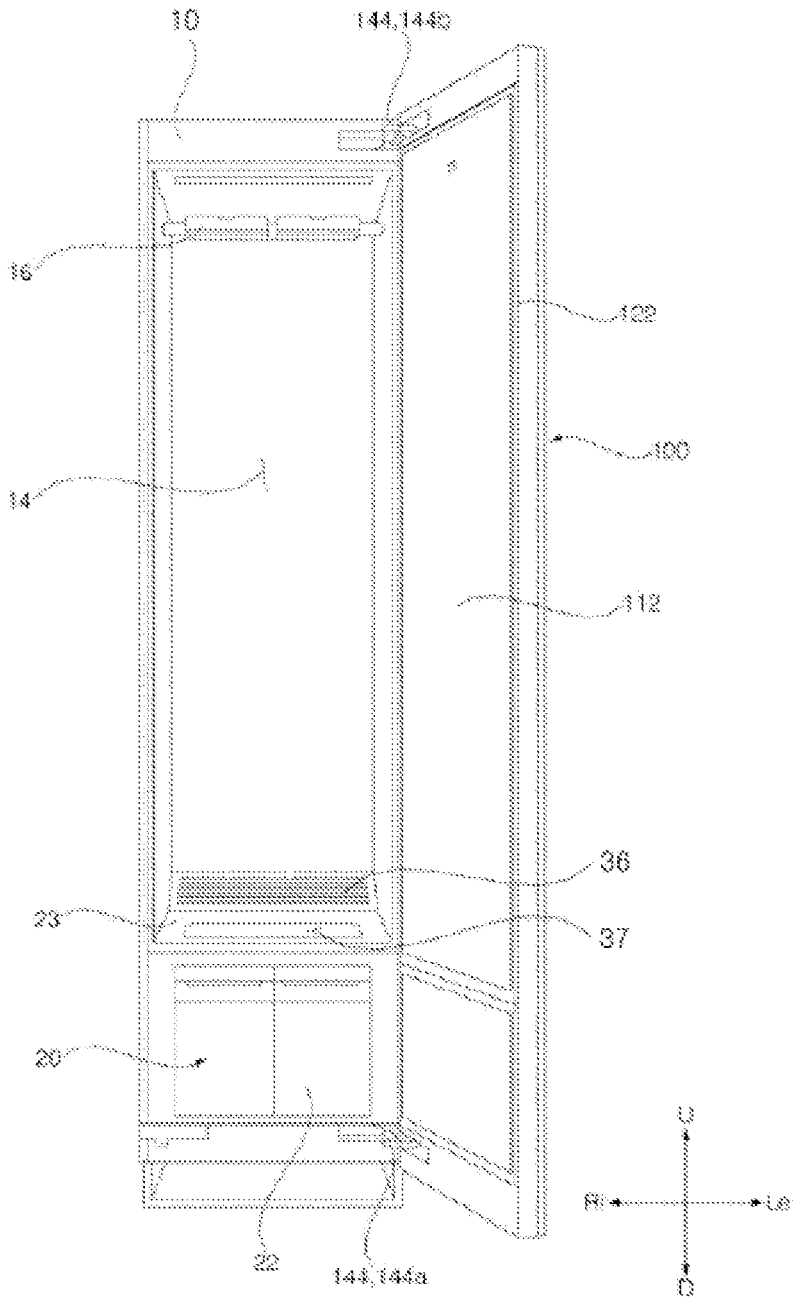
FIG. 2 illustrates the state that a cabinet of a laundry treating apparatus according to one embodiment of the present disclosure is opened.
Figure 3:
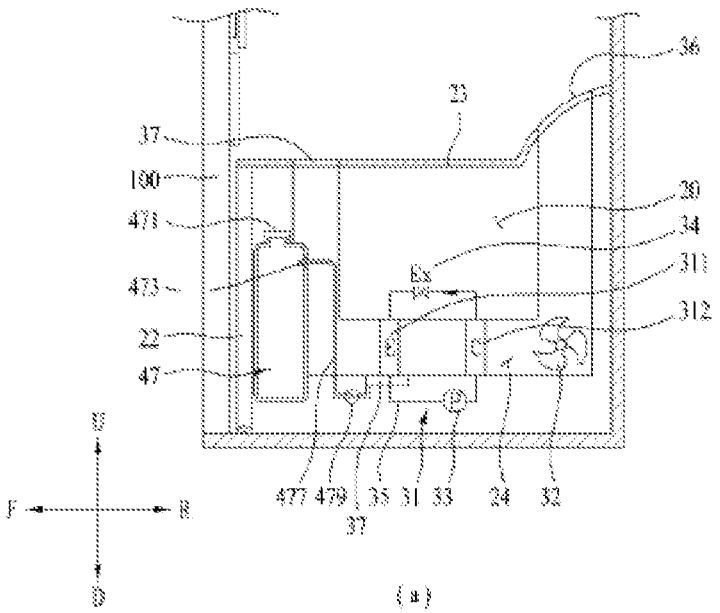
FIG. 3 illustrates a brief section of an inner structure of a machine chamber according to one embodiment of the present disclosure.
Figure 3:
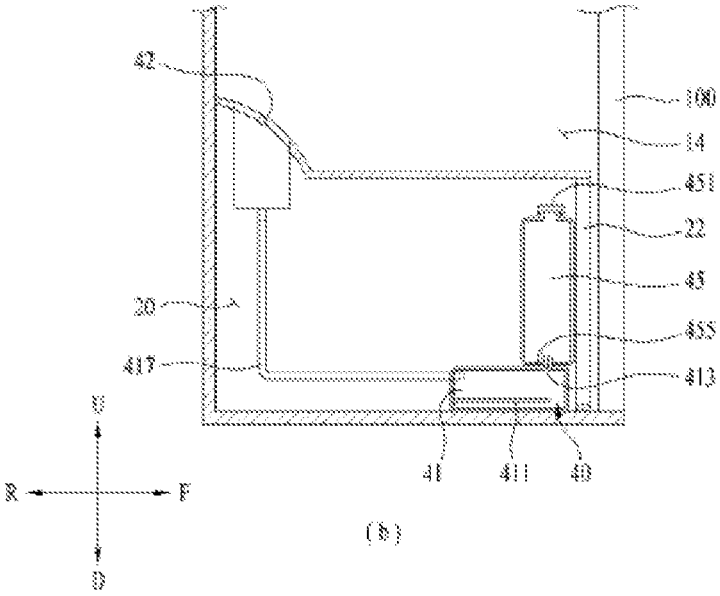
Figure 4:
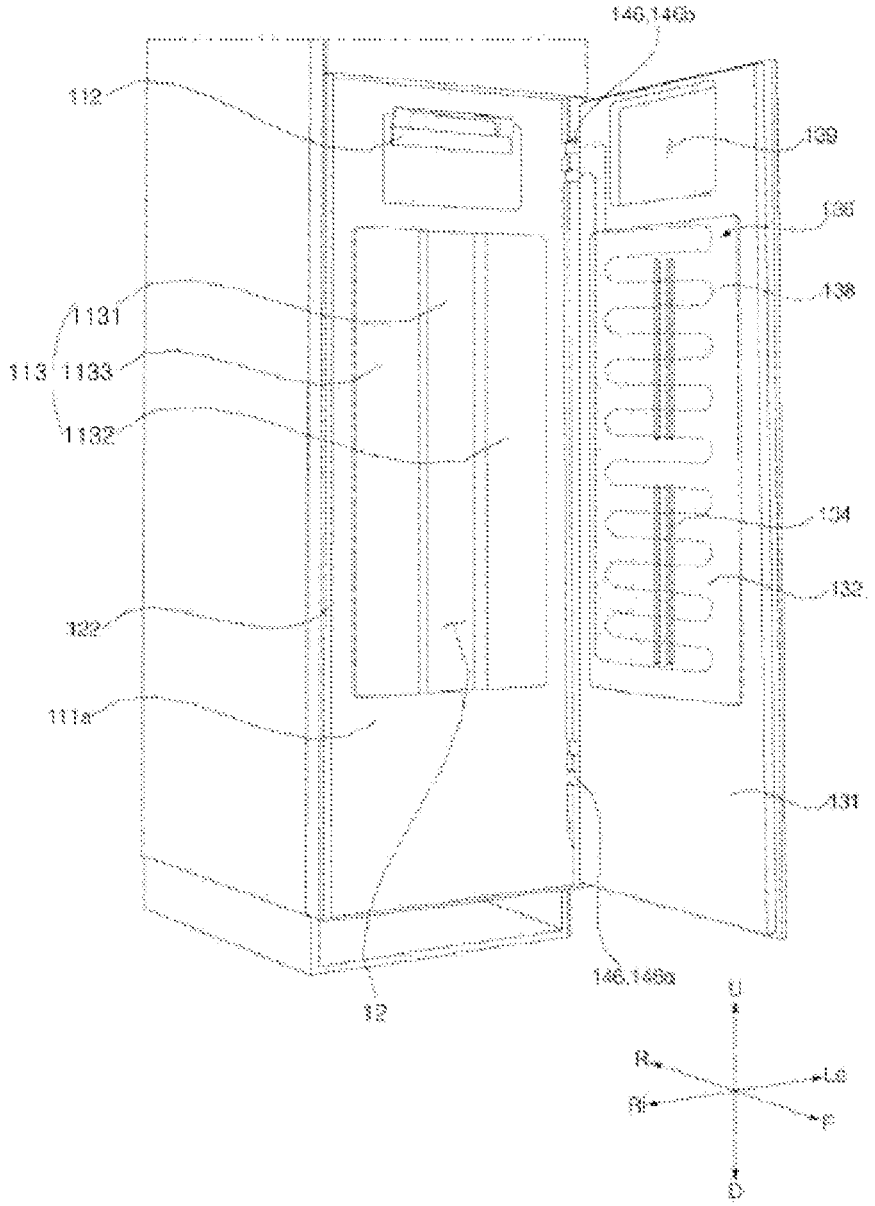
FIG. 4 illustrates an inner structure of a door assembly according to one embodiment of the present disclosure.

FIG. 1 is a perspective view illustrating that a door assembly 100 of a laundry treating apparatus 1000 according to one embodiment of the present disclosure is opened. FIG. 2 is a perspective view illustrating that a cabinet of a laundry treating apparatus according to one embodiment of the present disclosure is opened. FIG. 3 is a schematic sectional view illustrating an inner structure of a machine chamber 20 according to one embodiment of the present disclosure. FIG. 4 is a view illustrating an inner structure of a door assembly 100 according to one embodiment of the present disclosure.

Hereinafter, the laundry treating apparatus and the door assembly according to one embodiment of the present disclosure will be described with reference to FIGS. 1 to 4.

Referring to FIG. 2, the laundry treating apparatus according to this embodiment includes a cabinet 10 having a hollow inner portion and an opened front surface, and a door assembly 100 opening or closing the opened front surface of the cabinet 10.

The cabinet 10 according to this embodiment includes a first laundry treating chamber 11 for treating laundry through steam or air circulation by hanging laundry therein, and a machine chamber 20 provided with a unit for spraying steam to the first laundry treating chamber or circulating the air.

A laundry support bar 16 for hanging laundry or allowing a hanger for hanging laundry to be hung thereon is arranged at an upper side of the first laundry treating chamber 11 according to this embodiment. The laundry supporting bar 16 may be provided as a moving hanger for moving laundry in a left and right direction within a predetermined distance.

Referring to FIG. 3, the machine chamber 20 according to this embodiment may be provided to include at least one of an air supply unit 30 supplying the air (heated air or non-heated air) to an accommodating space 14 of the first laundry treating chamber 11 and a steam supply unit 40 supplying moisture (steam or mist) to the accommodating space 14.

To this end, the first treating chamber 11 may include an air discharge outlet 36 for discharging the air to the machine chamber 20, an air suction inlet 37 supplied with the air from the machine chamber 20, and a steam supply hole 42 supplied with moisture or steam from the machine chamber 20.

Since the machine chamber 20 generates the hot air having density relatively lower than the air, the machine chamber 20 may be provided below the first laundry treating chamber 11 to completely supply the hot air to the accommodating space 14.

The machine chamber 20 may be provided to include at least one of an air supply unit 30 for supplying the air (heated air or non-heated air) to the accommodating space 14 and a steam supply unit 40 for supplying moisture (steam or mist) to the accommodating space 14.

Hereinafter, for convenience of description, a description will be given based on that a supply unit includes both the air supply unit 30 and the moisture supply unit 40, wherein the air supply unit 30 supplies the hot air to the accommodating space 14 and the steam supply unit 40 supplies steam to the accommodating space 14.

The air supply unit 30 may include a first laundry treating chamber supply pipe 24 circulating the air inside the accommodating space 14, a heat exchanger 31 exchanging heat with the air moving along the first laundry treating chamber supply pipe 24, and a ventilating fan 32 allowing the air inside the accommodating space 14 to move along the first laundry treating chamber supply pipe 24.

The first laundry treating chamber supply pie 24 is communicated with the inside of the accommodating space 14 through the air discharge outlet 36 and the air suction inlet 37 provided in the accommodating space 14.

The air discharge outlet 25 and the air suction inlet 23 may be provided to pass through a bottom surface of the accommodating space 14 and provided to communicate the accommodating space 14 with the machine chamber 20. Therefore, if one end of the first laundry treating chamber supply pipe 24 provided inside the machine chamber 20 is connected to the air suction inlet 23 and the other end of the first laundry treating chamber supply pipe 24 is connected to the air discharge outlet 25, the first laundry treating chamber supply pipe 24 may be communicated with the inside of the accommodating space 14.

The heat exchanger 31 is a means for dehumidifying and heating the air entering the first laundry treating chamber supply pipe 24, and FIG. 3(*a*) illustrates a heat pump as an embodiment of the heat exchanger.

If the heat exchanger is provided as a heat pump, the heat exchanger 31 may include an evaporator E 311 provided inside the first laundry treating chamber supply pipe 24, a condenser C 312 arranged inside the first laundry treating chamber supply pipe 24, and a compressor P 33 and an expansion valve Ex 34 arranged outside the first laundry treating chamber supply pipe 24.

The evaporator E, the compressor P, the condenser C and the expansion valve Ex are connected with one another through a refrigerant pipe 35.

The compressor P is a means for compressing a refrigerant at high pressure to allow the refrigerant to circulate along the refrigerant pipe 35, the evaporator E is a means for evaporating the refrigerant by absorbing heat from the air inside the first laundry treating chamber supply pipe 24 and is also a means for dehumidifying and cooling the air, and the condenser C is a means for heating the air and condensing the refrigerant by emitting heat through the air inside the first laundry treating chamber supply pipe 24.

The ventilating fan 32 is a means arranged inside the first laundry treating chamber supply pipe 24, allowing the air inside the accommodating space 14 to circulate through the first laundry treating chamber supply pipe 24, and is arranged between the condenser C and the air discharge outlet 36.

Therefore, if the ventilating fan 32 is operated, the air inside the first laundry treating chamber supply pipe 24 moves to the accommodating space 14 through the air discharge outlet 36, and the air inside the accommodating space 14 moves to the first laundry treating chamber supply pipe 24 through the air suction inlet 37.

The air entering the first laundry treating chamber supply pipe 24 through the air suction inlet 23 is cooled by passing through the evaporator E, and the air that has passed through the evaporator E is heated by passing through the condenser C.

If the air is cooled by passing through the evaporator E, moisture contained in the air is removed (dehumidified), and moisture (condensed water) removed from the air remains on a surface of the evaporator or inside the first laundry treating chamber supply pipe.

If the condensed water remains inside the first laundry treating chamber supply pipe 24, since heat exchange efficiency of the heat exchanger 31 is deteriorated, the present disclosure may further include a drainage unit for removing condensed water generated by the evaporator E.

A water collecting pipe 37 collecting condensed water generated by heat exchange with the evaporator E may be arranged at one side of the first laundry treating chamber supply pipe 24 according to this embodiment. The condensed water collected in the water collecting pipe 37 may move to the drainage unit.

The drainage unit may include a drainage tank 47 detachably provided in a machine chamber door 22, and a drainage pipe 477 and a drainage pump 479 supplying the condensed water inside the first laundry treating chamber supply pipe 24 to the drainage tank 47.

The drainage tank 47 may be provided in any shape that may provide a space where liquid may be stored. However, the drainage tank 47 is preferably provided to include a drainage tank lid 471 for discharging liquid stored in the drainage tank, and a drainage tank inlet 473 detachably connected with the drainage pipe 477.

The drainage tank inlet 473 may further include a check valve (not shown), and this is allow the drainage pipe 477 to be detached from the drainage tank inlet 473 if the machine chamber door 22 opens the machine chamber 20 and allow the drainage pipe 477 to be inserted into the drainage tank inlet 473 if the machine chamber door 22 closes the machine chamber 20. Also, when the drainage tank is detached from the machine chamber door, water inside the drainage tank may be prevented from being leaked to the outside of the drainage tank.

Meanwhile, as shown in FIG. 3(*b*), the steam supply unit 40 may include a steam generator 41 provided inside the chamber 20, a heater 411 provided inside the steam generator 41, and a steam supply pipe 417 connecting the steam generator 41 to the steam supply hole 42.

The steam generator 41 is a means where water is stored, the heater 411 is a means for heating water stored in the steam generator 41 and converting the heated water to steam, and the steam supply pipe 417 is a means for guiding steam inside the steam generator 41 to the accommodating space 14.

Therefore, the heater 411 is preferably provided to adjoin a bottom surface of the steam generator 41, and the steam supply pipe 417 is preferably arranged on an upper surface (or uppermost end) of the steam generator 41.

The steam generator 41 may be supplied with water through a water supply unit, and the water supply unit may be provided as a water supply tank 45 detachably provided in the machine chamber door 22.

In this case, the steam generator 41 may be provided to further include a water supply tank connection pipe 413 connected to the water supply tank 45 if the machine chamber door 22 closes the machine chamber 20 and detached from the water supply tank 45 if the machine chamber door 22 opens the machine chamber 20.

The water supply tank 45 may be provided in any shape that may store liquid but is provided to include a water supply tank lid 451 for supplying liquid into the water supply tank 45, a discharge outlet (not shown) into which the water supply tank connection pipe 413 is inserted, and a water supply tank check valve 455 provided in the discharge outlet.

The water supply tank 45 is detachably provided in the machine chamber door 22 considering that the laundry treating apparatus 1000 of the present disclosure is provided at a place far away from a water supply source (not shown).

Also, the water supply tank 45 and the drainage tank 47 may be provided as one storage tank without being provided separately from each other. In this case, the condensed water stored in the storage tank may be reused, or may directly be discharged to the outside without being stored in the storage tank through the drainage pipe 477.

That is, if the laundry treating apparatus 1000 is provided to adjoin the water supply source, the steam generator 41 may be controlled to be supplied with water from the water supply source if necessary. However, if the laundry treating apparatus 1000 is provided to be far away from the water supply source, the steam generator 41 cannot be controlled as above. The water supply tank 45 is a means for solving this problem.

Referring to FIGS. 1 and 4, the door assembly 100 according to this embodiment forms a second laundry treating chamber 12, which may remove wrinkles by pressurizing laundry, therein. The door assembly door 130 according to this embodiment may be arranged in a front direction F of the door assembly 100 to open or close the second laundry treating chamber 12 formed inside the door assembly 100, in the front direction F.

The door assembly 100 according to this embodiment includes an assembly housing 110 opening or closing the opened front surface of the cabinet 10 and forming an inner space therein to treat laundry, and an assembly door 130 opening or closing the inner space formed by the assembly housing 110.

The second laundry treating chamber 12 is arranged inside the door assembly 100. The second laundry treating chamber 12 may have a shape opened toward a front direction from the door assembly 100, and may be disconnected from the outside by the assembly door 130. The assembly door 130 may serve as a door that opens or closes the inner space of the second laundry treating chamber 12. Therefore, the second laundry treating chamber 12 may only be opened or closed by the assembly door 130 even without opening or closing the first laundry treating chamber 11 through the assembly housing 110. This is referred to as a door in door type.

The second laundry treating chamber 12 removes wrinkles of laundry arranged therein by applying a pressure to the laundry. In the second laundry treating camber 12, the laundry is arranged between an inner side 111*a* of the assembly housing 110 and an inner side 131 of the assembly door 130.

A fixed member 114 fixing laundry to hang the laundry to a downward side D, a base plate 113 supporting the laundry arranged therein and a press plate 132 tightly attached to the base plate 113, pressurizing the laundry arranged between the base plate and the press plate 132 are arranged in the second laundry treating chamber 12. A tension bar 134 longitudinally protruded in an up and down direction U-D may be formed to be protruded at the center of the press plate 132 according to this embodiment. The tension bar 134 may apply tension to the laundry arranged between the press plate 132 and the base plate 113 toward the base plate 113, whereby tension may be applied to both sides of the laundry.

The fixed member 114 may be arranged in any one of the assembly housing 110 and the assembly door 130. The base plate 113 may be arranged at the inner side 111*a* of the assembly housing 110 or the inner side 131 of the assembly door 130, and the press plate 132 may be arranged in the assembly housing 110 or the assembly door 130, which is not arranged in the base plate 113.

Referring to FIGS. 1 and 4, the fixed member 114 and the base plate 113 are arranged in the assembly housing 110 of the door assembly 100 of the laundry treating apparatus 10 according to this embodiment, and the press plate 132 is arranged in the assembly door 130. Also, in the assembly door 130, a fixed member groove 139 may be formed at a portion corresponding to the fixed member 114 protruded from the inner side of the assembly housing 110. This will be described with reference to FIGS. 1 and 4. However, this is only exemplary, and different arrangements may be made within the range that may fix and pressurize the laundry.

The assembly housing 110 according to this embodiment forms an external appearance of the door assembly 100. The assembly housing 110 according to this embodiment is provided with the second laundry treating chamber 12 therein, wherein the second laundry treating chamber 12 is a space where the laundry is pressurized and treated. The assembly housing 110 according to this embodiment forms the second laundry treating chamber 12 therein, and the front surface of the second laundry treating chamber 12 is opened.

The assembly housing 110 according to this embodiment is rotatably connected at one side of the cabinet 10. One side of an upper end of the assembly housing 110 according to this embodiment and one side of a lower end of the assembly housing 110 may be fixed to the cabinet 10 by a hinge.

Referring to FIG. 2, in a state that the assembly housing 110 closes the front surface of the cabinet 10, a rear surface 112 of the assembly housing 110 is arranged toward the first laundry treating chamber 11 of the cabinet 10. A door gasket 122 for sealing the outside of the cabinet 10 and the first laundry treating chamber 11 in a state that the front surface of the cabinet 10 is closed may be arranged in the rear surface 122 of the assembly housing 110.

In the laundry treating apparatus 10 according to this embodiment, in a state that the assembly housing 110 closes the front surface of the cabinet 10, the front surface 111 of the assembly housing 110 is arranged toward the front direction of the cabinet 10. A portion of the front surface 11 of the assembly housing 110 according to this embodiment may be formed to be recessed toward a rear direction to become the inner side 111*a* of the assembly housing 110, and at the same time may form the inner side 111*a* of the second laundry treating chamber 12.

In the door assembly 100 according to this embodiment, in a state that the assembly door 130 is closed in the assembly housing 110, a surface arranged in the space for forming the second laundry treating chamber 12 may be defined as the inner side. Also, in the door assembly 100 according to this embodiment, in a state that the assembly door 130 is closed in the assembly housing 110, a surface forming an external appearance of the door assembly 100 may be defined as an outer side. Therefore, even in case of the front surface of the assembly housing 110, the surface forming the external appearance of the door assembly 100 may be defined as the outer side.

The assembly housing 110 according to this embodiment forms the second laundry treating chamber 12 therein, in which laundry is treated. The fixed member 114 for fixing laundry to the inner side 111*a* where the second laundry treating chamber 12 is formed and the base plate 113 for pressurizing the laundry fixed to the fixed member 114 together with the assembly door 130 are arranged in the assembly housing 110 according to this embodiment.

The base plate 113 includes a base fixed plate 1131 fixed to the assembly housing 110, and base elastic plates 1132 and 1133 formed to be extended from the base fixed plate 1131 and formed to be more spaced apart from the inner side 111*a* of the assembly housing 110 than the base plate 1131, providing an elastic force to laundry.

In this embodiment, the base fixed plate 1131 is formed to be longitudinally extended from the inner side 111*a* of the assembly housing 110 in an up and down direction, and its upper and lower sides are fastened to the assembly housing 110 by a fastening member. Therefore, the base fixed plate 1131 may maintain the state coupled to the inner side of the assembly housing 110. The base fixed plate 1131 may be provided with a base fixed plate hole 117 formed in a space between portions fastened to the assembly housing 110 at upper and lower sides. The portion for pressurizing laundry in the base plate 113 is formed in the base elastic plates 1132 and 1133.

The base elastic plates 1132 and 1133 may be divided into the base elastic right plate 1182 and the base elastic left plate 1183, which are formed to be respectively extended from the base fixed plate 1131 in left and right directions.

The base elastic right plate 1182 and the base elastic left plate 1183 may elastically be deformed toward the inner side 111*a* of the assembly housing 110 by material elasticity.

Therefore, when the base plate 113 is pressurized by the press plate 132 of the assembly door 130, the base elastic plates 1132 and 1133 of the base plate 113 may be spaced apart from each other toward the inner side 11*a* of the assembly housing 110 and tightly attached to the assembly door 130.

The assembly door 130 according to this embodiment is arranged on the front surface 111 of the assembly housing 110. The assembly door 130 according to this embodiment is rotatably connected at one side of the assembly housing 110. The assembly door 130 according to this embodiment opens or closes the second laundry treating chamber 12.

The press plate 132 for pressurizing the laundry hung in the second laundry treating chamber 12 together with the base plate 113 is arranged on the inner side 131 of the assembly door 130 according to this embodiment. The press plate 132 according to this embodiment is arranged in the assembly door 130 of the portion corresponding to the base plate 113.

A heating unit 136 for heating the press plate 132 may be arranged inside the assembly door 130 provided with the press plate 132 according to this embodiment. The heating unit 136 according to this embodiment may include a press plate electric heater 138 generating heat through electricity supplied from an external power source. The press plate electric heater 138 may be arranged inside the press plate 132 to emit heat to the press plate 132. Therefore, wrinkles existing in the laundry pressurized by the base plate 113 and the press plate 132 may be removed using heat generated from the press plate 132.

Figure 5:
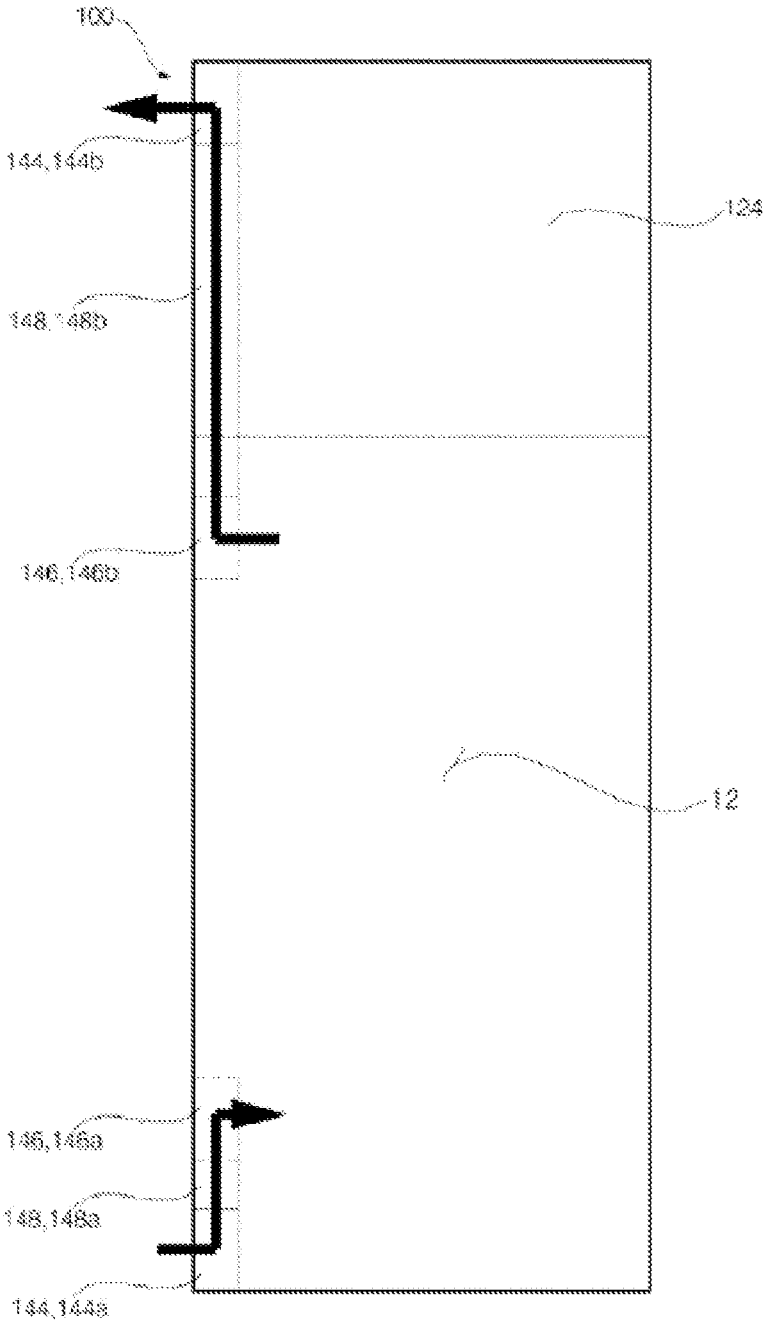
FIG. 5 illustrates a steam circulating structure of a door assembly according to another embodiment of the present disclosure.
Figure 6:
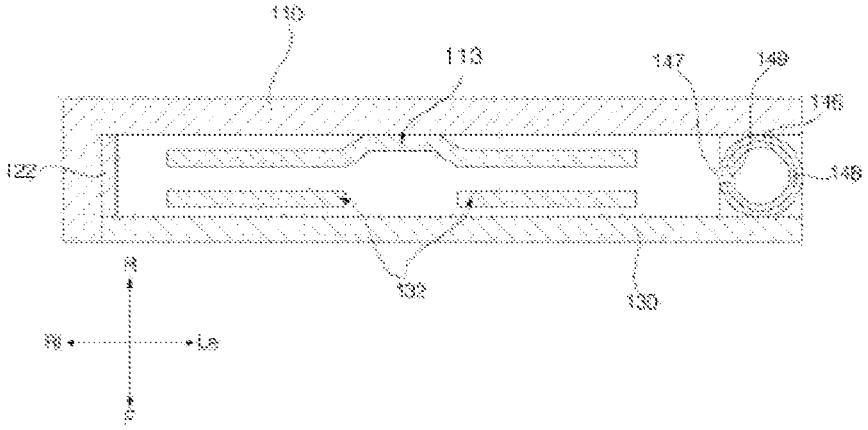
FIG. 6 relates to another embodiment of the present disclosure, FIG. 6(*a*) illustrates the state that an assembly door of a door assembly is closed, and FIG. 6(*b*) illustrates the state that an assembly door of a door assembly is opened.
Figure 6:
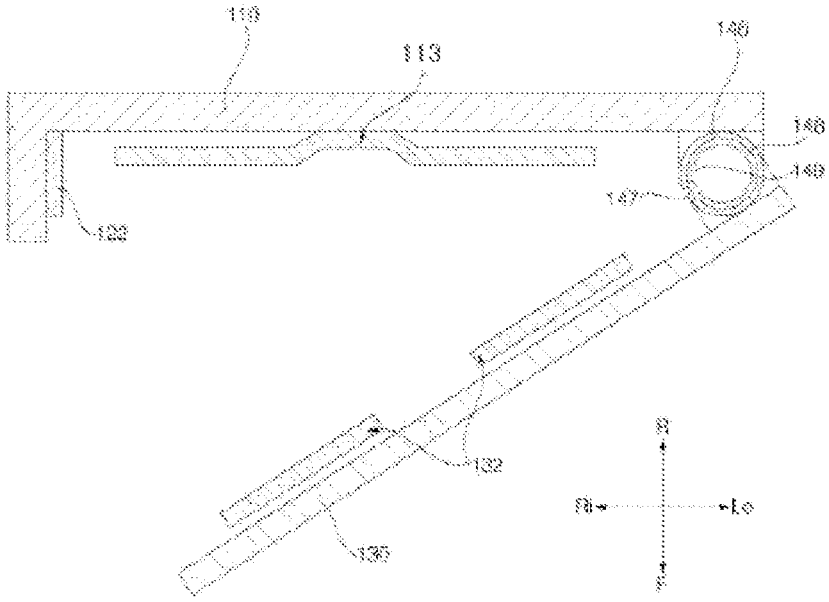

FIG. 5 is a view illustrating a steam circulating structure of a door assembly 100 according to another embodiment of the present disclosure. FIG. 6 is a view illustrating a hinge unit through which steam of a door assembly according to another embodiment of the present disclosure moves.

Hereinafter, a structure for moving steam to the inside of the door assembly 100 according to this embodiment will be described with reference to FIGS. 5 and 6.

Referring to FIG. 5, the laundry treating apparatus 10 according to another embodiment of the present disclosure may further include door steam supply units 144*a*, 146*a* and 148*a* supplying steam to the second laundry treating chamber 12 formed inside the door assembly 100. The laundry treating apparatus 10 according to this embodiment may further include door steam discharge units 144*b*, 146*b* and 148*b* discharging steam moving inside the door assembly 100.

The door steam supply units 144*a*, 146*a* and 148*a* according to this embodiment may partially supply steam generated from the steam supply unit 40 arranged inside the machine chamber 20 to the second laundry treating chamber 12 inside the door assembly 100.

The door assembly 100 according to this embodiment is rotatably connected to the cabinet 10. The laundry treating apparatus 10 according to this embodiment further includes a cabinet hinge unit 144 rotatably connecting the door assembly 100 to the cabinet 10. The cabinet hinge unit 144 according to this embodiment may rotatably connect the door assembly 100 with the cabinet 10 at upper and lower ends of the door assembly 100.

The cabinet hinge unit 144 according to this embodiment includes a first cabinet hinge unit 144*a* arranged at the upper end of the door assembly 100, and a second cabinet hinge unit 144*b* arranged at the lower end of the door assembly 100. Each of the first and second cabinet hinge units 144*a* and 144*b* according to this embodiment may be provided with a hollow inner portion. Therefore, steam may move inside the first and second cabinet hinge units 144*a* and 144*b*, or each of the first and second cabinet hinge units 144*a* and 144*b* may be provided with a hose in which steam moves.

The assembly door 130 of the door assembly 100 according to this embodiment is rotatably connected to the assembly housing 110. The door assembly 100 according to this embodiment further includes an assembly hinge unit 146 rotatably connecting the assembly door 130 to the assembly housing 110. The assembly hinge unit 146 according to this embodiment rotatably connects the assembly door 130 with the assembly housing 110 at the upper and lower ends of the assembly door 130.

The assembly hinge unit 146 according to this embodiment includes a first assembly hinge unit 146*a* arranged at an upper portion of the assembly door 130, and a second assembly hinge unit 146*b* arranged below the assembly door 130. Each of the first and second assembly hinge units 146*a* and 146*b* according to this embodiment may be provided with a hollow inner portion. Therefore, steam may move inside the first and second assembly hinge units 146*a* and 146*b*, or each of the first and second assembly hinge units 146*a* and 146*b* may be provided with a hose in which steam moves.

A connection pipe 148 according to this embodiment may include a first connection pipe 148*a* connecting the first cabinet hinge unit 144*a* with the first assembly hinge unit 146*a*, and a second connection pipe 148*b* connecting the second cabinet hinge unit 144*b* with the second assembly hinge unit 146*b*.

Steam generated from the steam generator 44 of the machine chamber 20 may move inside the connection pipe 148 according to this embodiment, or the connection pipe 148 may be provided with a hose in which steam moves.

The steam supply unit 140 according to this embodiment may include a first connection pipe 148*a* connecting the first cabinet hinge unit 144*a* with the first assembly hinge unit 146*a*. The door steam discharge units 144*b*, 146*b* and 148*b* according to this embodiment may include a second connection pipe 148*b* connecting the second cabinet hinge unit 144*b* with the second assembly hinge unit 146*b*.

Referring to FIG. 6, the connection pipe 148 according to this embodiment may be inserted into the inner side of the assembly hinge unit 146. The connection pipe 148 according to this embodiment may be provided with a connection pipe hole 149 opened to move steam at a portion which is in contact with the assembly hinge unit 146. The connection pipe 148 is fixedly arranged at the inner side of the assembly hinge unit 146. Therefore, even though the assembly hinge unit 146 is rotated, arrangement of the connection pipe 148 is not changed.

The assembly hinge unit 146 according to this embodiment may be arranged at an outer circumference of the connection pipe 148. The assembly hinge unit 146 according to this embodiment is fixedly connected with the assembly door 130. Therefore, the assembly hinge unit 146 may be rotated together with the assembly door 130 in accordance with rotation of the assembly door 130. The assembly hinge unit 146 according to this embodiment is provided with an assembly hinge unit hole 147 communicating the inside of the connection pipe 148 with the second laundry treating chamber 12.

When the assembly hinge unit hole 147 according to this embodiment is arranged in the same direction as the connection pipe hole 149, steam moving inside the connection pipe 148 may be supplied to the second laundry treating chamber 12, or steam moving inside the second laundry treating chamber 12 may move to the connection pipe 148.

The door assembly 100 according to this embodiment may communicate the connection pipe 148 with the second laundry treating chamber 12 when the assembly door 130 closes the second laundry treating chamber 12. The door assembly 100 according to this embodiment may be configured so as not to communicate the connection pipe 148 with the second laundry treating chamber 12 when the assembly door 130 opens the second laundry treating chamber 12.

That is, referring to FIG. 6(*a*), in the door assembly 100 according to this embodiment, when the assembly door 130 closes the second laundry treating chamber 12, the assembly hinge unit hole 147 may be arranged in the same direction as the connection pipe hole 149. Also, in the door assembly 100 according to this embodiment, when the assembly door 130 opens the second laundry treating chamber 12, the assembly hinge unit hole 147 and the connection pipe hole 149 may be arranged in their respective directions different from each other.

Figure 7:
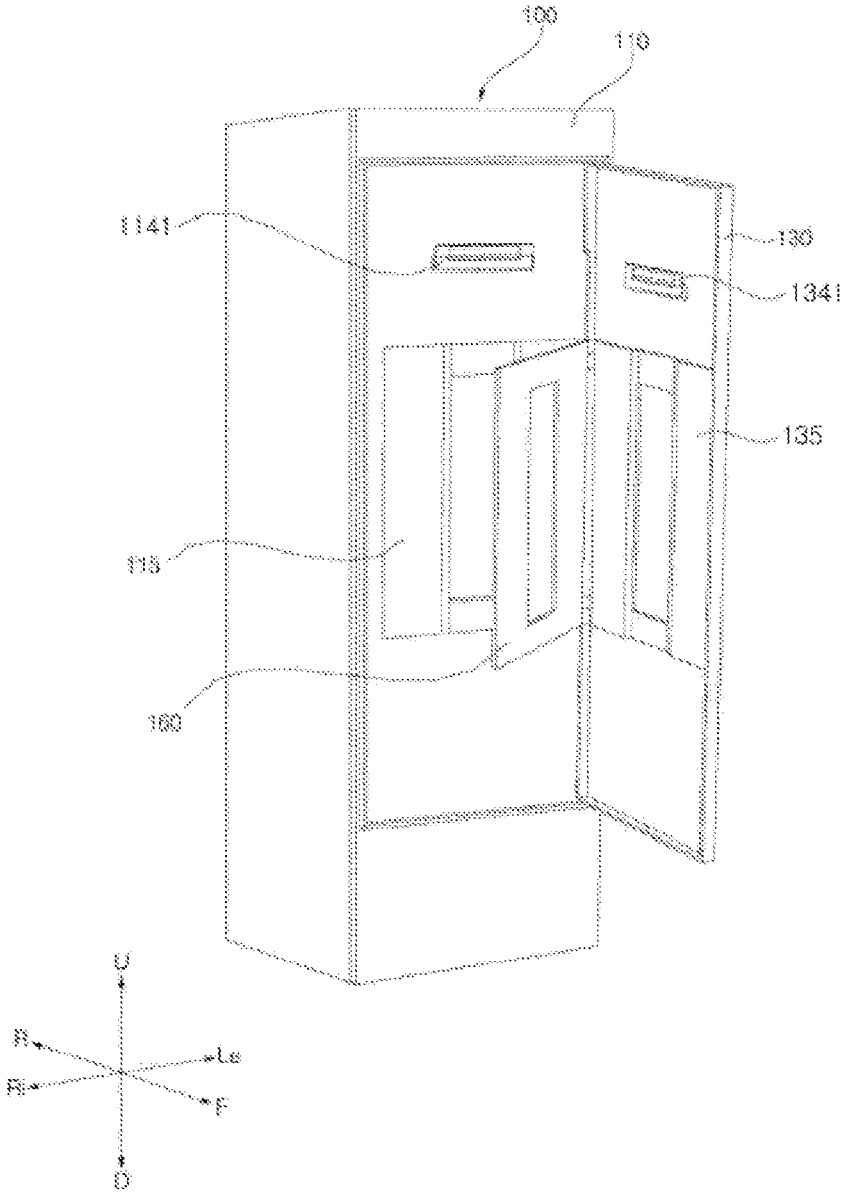
FIG. 7 illustrates a door assembly according to another embodiment of the present disclosure.
Figure 8:
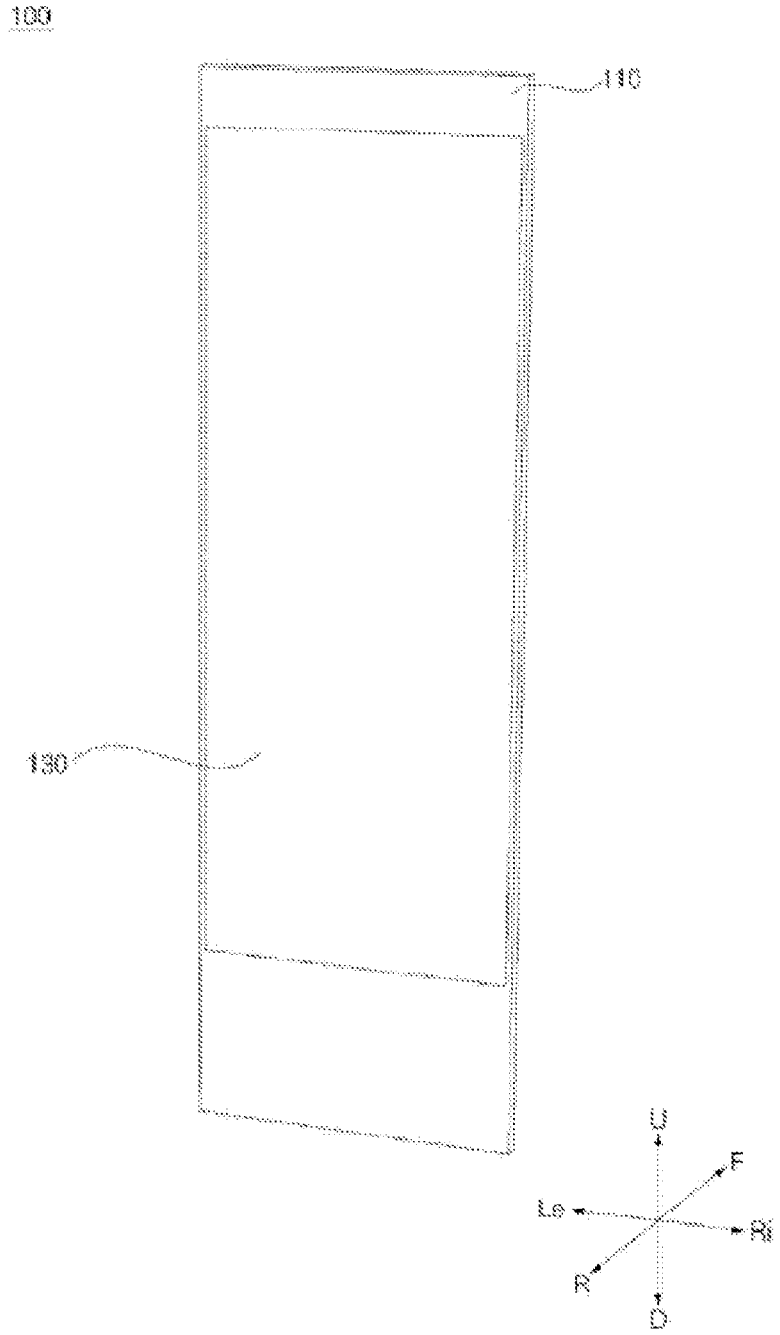
FIG. 8 illustrates the state that a door assembly according to another embodiment of the present disclosure is closed.
Figure 9:
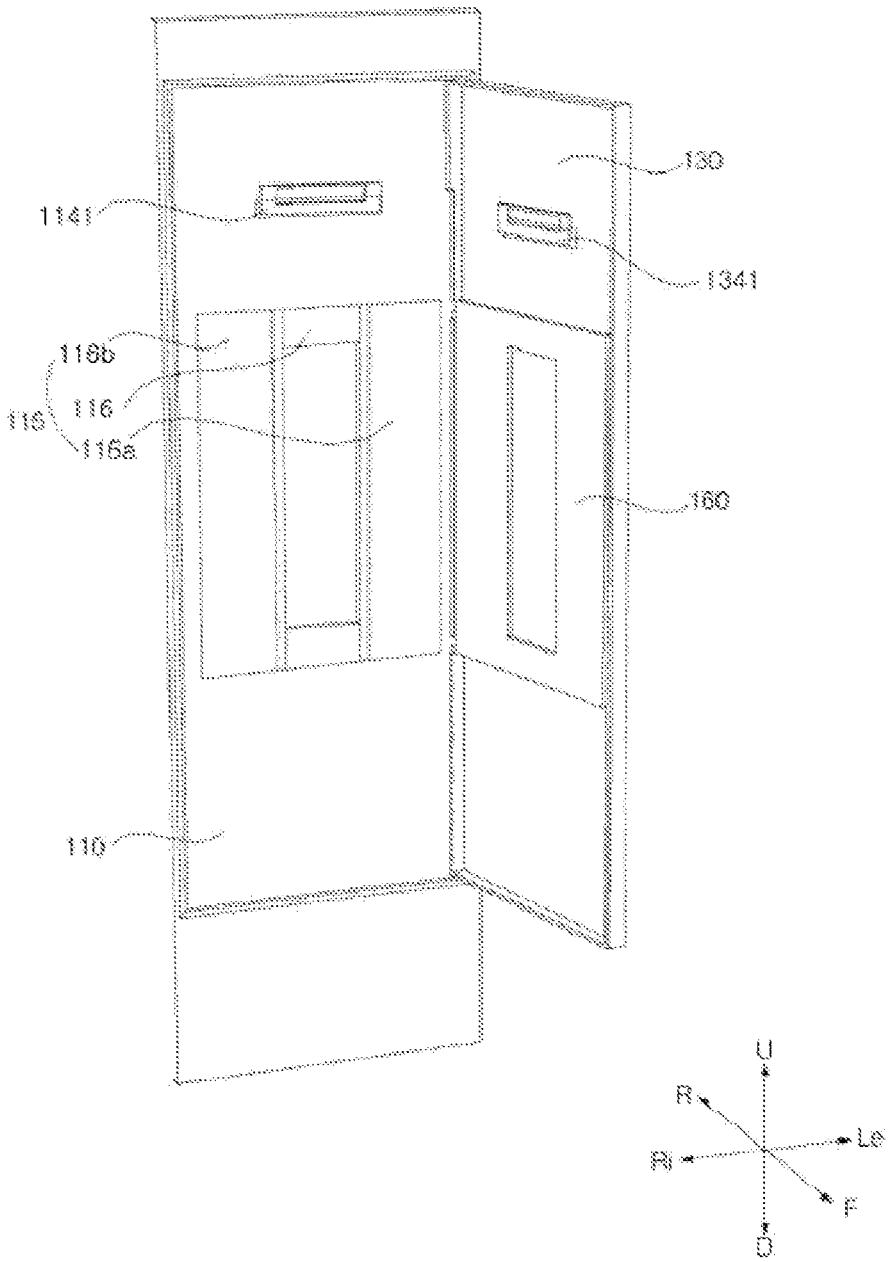
FIG. 9 illustrates the state that a door assembly according to another embodiment of the present disclosure is opened.
Figure 10:
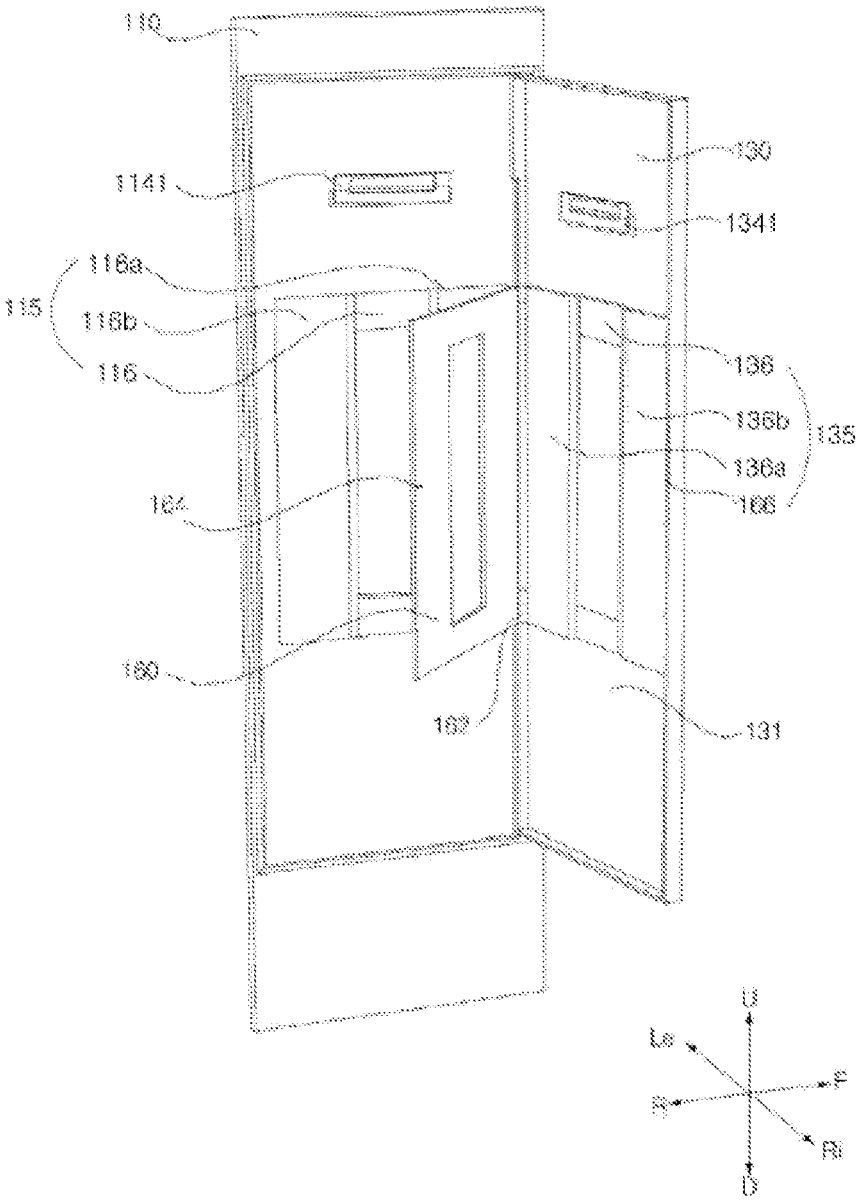
FIG. 10 illustrates the state that a door assembly according to another embodiment of the present disclosure is opened and partition plates are spaced apart from each other.
Figure 11:
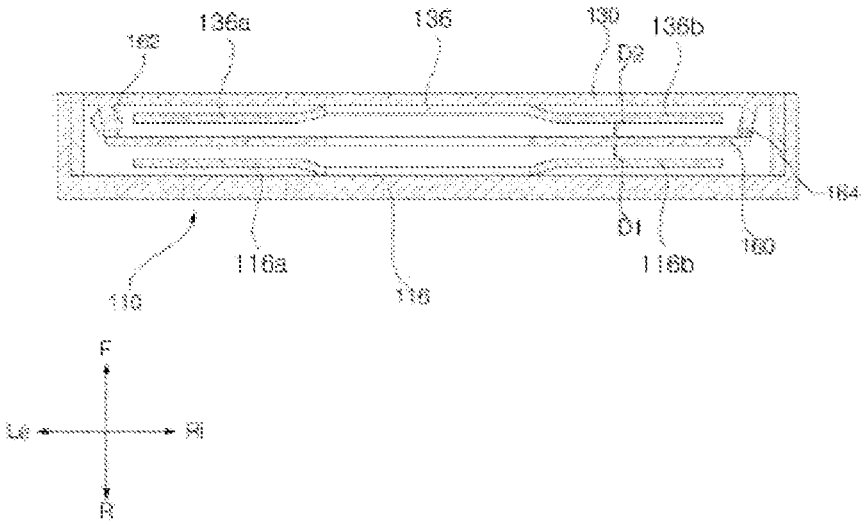
FIG. 11 illustrates an inner structure of a door assembly according to another embodiment of the present disclosure.

FIG. 7 is a perspective view illustrating a door assembly according to another embodiment of the present disclosure. FIGS. 8 to 10 are views illustrating a structure and a switching structure of a door assembly according to another embodiment of the present disclosure. FIG. 11 is a view illustrating an inner structure of a door assembly according to another embodiment of the present disclosure.

Hereinafter, a structure of the door assembly according to this embodiment will be described with reference to FIGS. 6 to 10.

Referring to FIG. 7, in the door assembly 100 of the laundry treating apparatus 1000 according to another embodiment of the present disclosure, a partition plate 160 may be arranged between the assembly housing 110 and the assembly door 130 to remove wrinkles by pressurizing at least two laundry items. Therefore, a plurality of laundry items may simultaneously be pressurized by the partition plate.

A first fixing member 1141 fixing laundry and a first base plate 115 pressurizing the laundry fixed to the assembly housing 110 together with the partition plate 160 are arranged at the inner side 111*a* of the assembly housing 110 according to this embodiment.

The first base plate 115 includes a first base fixed plate 116 fixed to the assembly housing 110, and first base elastic plates 116*a* and 116*b* formed to be extended from the first base fixed plate 116 and formed to be more spaced apart from the inner side 111*a* of the assembly housing 110 than the first base fixed plate 116, providing an elastic force to laundry.

A second fixing member 1341 fixing laundry and a second base plate 135 pressurizing the laundry fixed to the assembly door 130 together with the partition plate 160 are arranged at the inner side 131 of the assembly door 130 according to this embodiment.

The second base plate 135 includes a second base fixed plate 136 fixed to the assembly door 130, and second base elastic plates 136*a* and 136*b* formed to be extended from the second base fixed plate 136 and formed to be more spaced apart from the inner side 131 of the assembly door 130 than the second base fixed plate 136, providing an elastic force to laundry.

The partition plate 160 is hinge-fixed to one side of the assembly door 130 or the assembly housing 110. Referring to FIG. 10, the partition plate 160 according to this embodiment is hinge-fixed to one side of the assembly door 130. The partition plate 160 according to this embodiment is rotatably fixed to the assembly door 130 at one side and detachably fixed to the assembly door 130 at the other side. When the partition plate 160 according to this embodiment is fixed to the assembly door 130 at the other side, the partition plate 160 may be spaced apart from the assembly door 130.

The partition plate 160 according to this embodiment includes a partition plate-hinge unit 162 rotatably fixed to the assembly door 130, and a fixing protrusion 164 fixing the partition plate 160 to one side of the assembly door 130 as the partition plate is rotated using the partition plate-hinge unit 162 as a shaft, or releasing fixture. The fixing protrusion 164 may be fixed to one side of the assembly door 130 according to this embodiment, or the assembly door 130 may include a fixing groove unit 166 configured to release fixture.

The fixing protrusion 164 of the partition plate 160 according to this embodiment and the fixing groove unit 166 of the assembly door 130 may be one-touch click buttons. Therefore, if the fixing protrusion 164 of the partition plate 160 is pressurized toward the assembly door 130, the partition plate 160 may be fixed to the assembly door 130, or its fixture may be released.

The fixing protrusion 164 may be spaced apart from the assembly door by fixing the partition plate 160 to the assembly door 130, thereby pressurizing the laundry hung on the assembly door 130. The fixing protrusion 164 may hang laundry on the assembly door 130 or remove the laundry from the assembly door 130 by releasing the fixture of the partition plate 160 from the assembly door 130.

The assembly housing 110 and the assembly door 130 according to this embodiment are spaced apart from each other at a certain interval. The assembly housing 110, the partition plate 160 and the assembly door 130 according to this embodiment are spaced apart from one another each other at a certain interval. In a state that the second laundry treating chamber 12 is closed, a spaced distance D1 from the first base elastic plates 116*a* and 116*b* of the assembly housing 110 to the partition plate 160 may be equal to a spaced distance D2 from the partition plate 160 to the second base elastic plates 136*a* and 136*b* of the assembly door 130. In a state that the second laundry treating chamber 12 is closed, the spaced distance D1 from the first base elastic plates 116*a* and 116*b* of the assembly housing 110 to the partition plate 160 and the spaced distance D2 from the partition plate 160 to the second base elastic plates 136*a* and 136*b* of the assembly door 130 include a state of '0'. That is, in a state that the second laundry treating chamber 12 is closed, each of the first base elastic plates 116*a* and 116*b* of the assembly housing 110 and the second base elastic plates 136*a* and 136*b* of the assembly door 130 may be tightly attached to the partition plate 160.

However, in a state that the second laundry treating chamber 12 is closed, the spaced distance D1 from the first base elastic plates 116*a* and 116*b* of the assembly housing 110 to the partition plate 160 and the spaced distance D2 from the partition plate 160 to the second base elastic plates 136*a* and 136*b* of the assembly door 130 may be set at their respective intervals different from each other considering types of laundry items hung in the second laundry treating chamber 12.

In a state that the second laundry treating chamber 12 is closed, the first base elastic plates 116*a* and 116*b* of the first base plate 115 and the second base elastic plates 136*a* and 136*b* of the second base plate 135 may be arranged to contact or adjoin the partition plate 160. In a state that the second laundry treating chamber 12 is closed, when laundry is hung in the assembly housing 110, the first base elastic plates 116*a* and 116*b* may move to the assembly housing 110 by the laundry hung in the assembly housing 110. In a state that the second laundry treating chamber 12 is closed, when laundry is hung in the assembly door 130, the second base elastic plates 136*a* and 136*b* may move to the assembly door 130 by the laundry hung in the assembly door 130.

If the fixing protrusion 164 of the partition plate 160 is fixed to the fixed groove unit 166 of the assembly door 130, the laundry hung in the assembly door 130 may be pressurized by the partition plate 160 and the second base plate 135 of the assembly door 130. In a state that the partition plate 160 is fixed to the assembly door 130, if the assembly door 130 is fixed to the assembly housing 110, the laundry hung in the assembly housing 110 may be pressurized by the partition plate 160 and the first base plate 115 of the assembly housing 110.

Figure 12:
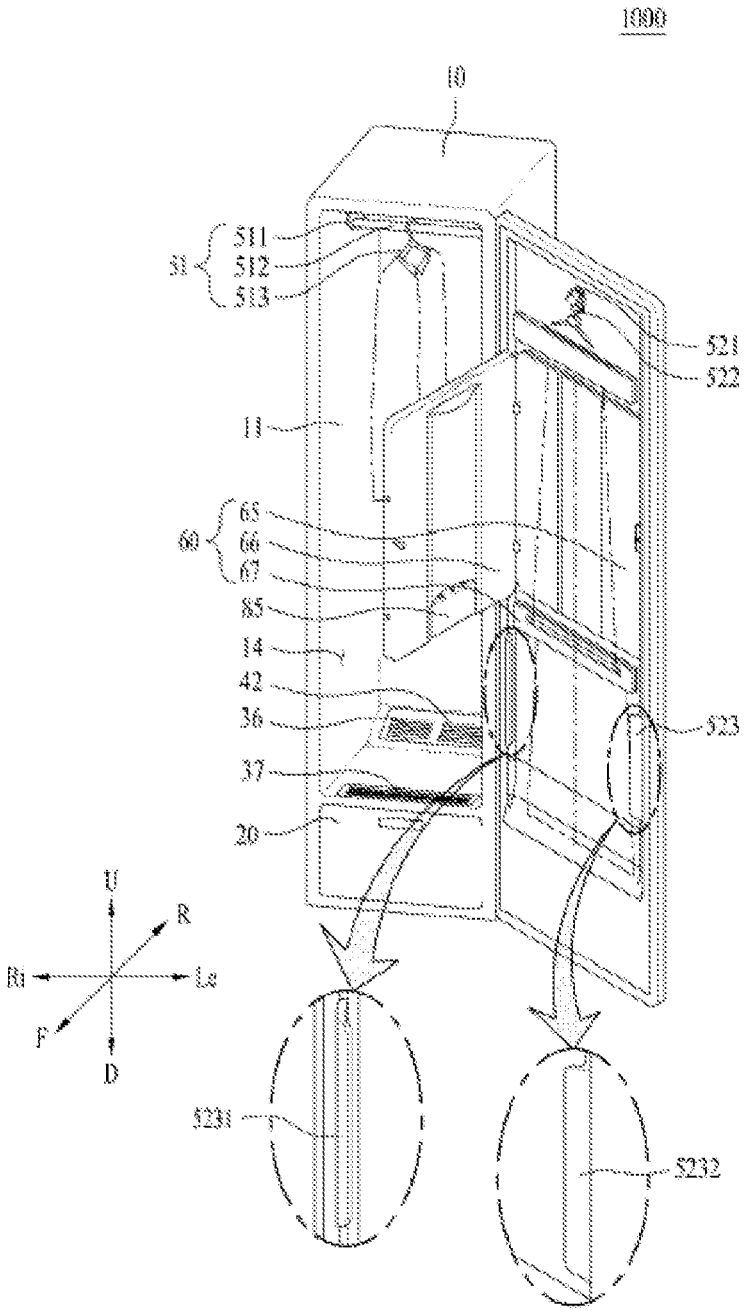
FIG. 12 illustrates a structure of a laundry treating apparatus of the related art.

FIG. 12 illustrates a structure of a laundry treating apparatus of the related art.

The laundry treating apparatus of the related art includes auxiliary hangers 521 and 522 provided inside the door to fix the laundry, and a pressurizer 60 provided below the auxiliary hanger 50. The auxiliary hanger 50 includes a hanger 522, a hook unit 521 provided in the door to fix the hanger 522, and the pressurizer 60 includes a support unit 65 supporting one surface of the laundry, a pressurizing unit 66 rotatably provided toward the support unit 65 to pressurize the other surface of the laundry, and a stabilizer 67 provided below the pressurizing unit 66 to prevent torsion of the laundry from occurring.

However, since the pressurizing unit 66 pressurizes the laundry while rotating, a problem occurs in that the laundry is not pressurized uniformly. A problem also occurs in that the laundry item P is twisted or displaced by being pushed by the pressurizer 65 while the pressurizer 60 is pressurizing the laundry item P. That is, the laundry treating apparatus of the related art has a problem in that more wrinkles of the laundry item P are generated due to the pressurizer 65 or unintended wrinkles are generated.

Also, when the laundry item is provided with bottoms divided into areas, the laundry treating apparatus of the related art has a problem in that the divided areas cannot be pressurized respectively. For example, when the laundry item is provided with bottoms such as pants, in the laundry treating apparatus of the related art, a first part worn on a left leg of a user and a second part worn on a right leg of the user are pressurized by being overlapped with each other.

Therefore, the first part and the second part are alternately overlapped with each other while the first part and the second part are being pressurized, or a problem occurs in that a crease occurs in an unintended area of the laundry.

Also, since the hot air or moisture (including steam) is not supplied to the area where the first part faces the second part, a problem occurs in that refresh such as drying and deodorization is not performed actively.

Figure 13:
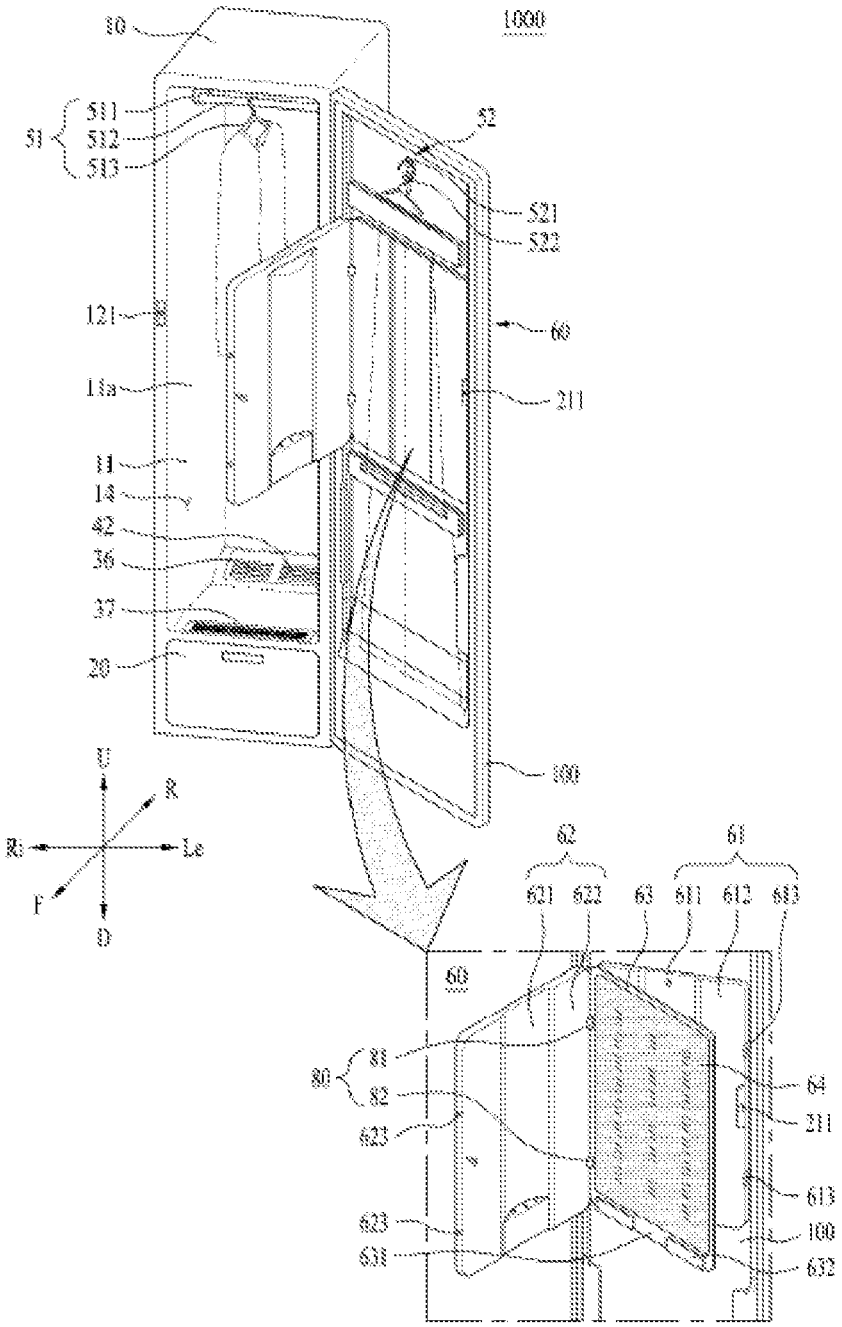
FIG. 13 illustrates a structure of a laundry treating apparatus according to one embodiment of the present disclosure.

Referring to FIG. 13, to solve the aforementioned problems, the laundry treating apparatus 1000 according to one embodiment of the present disclosure includes a cabinet 10 having an opening in a front direction, a door assembly 100 rotatably provided in the cabinet 10 to open or close the opening, a first laundry treating chamber 11 provided in the cabinet 10, providing an accommodating space 14 in which the laundry item P is accommodated, a machine chamber 20 communicated with the first laundry treating chamber 11 and provided to supply at least any one of the air and moisture to the accommodating space 14, and an ironing pressurizer 60 provided in at least any one of the first laundry treating chamber 11 and the door assembly 100 to pressurize the laundry item. FIG. 11 illustrates the case that the ironing pressurizer is provided in the door assembly, but the ironing pressurizer may be provided in the first laundry treating chamber not the door assembly. In this case, the case that the ironing pressurizer is provided in the door assembly will be described.

The cabinet 10 is provided to form an external appearance of the laundry treating apparatus 1000, and its height may be provided to be longer than its width. As a result, the laundry item P provided to have a long length like pants may be accommodated in the accommodating space 14 without being folded, whereby a crease may be prevented from occurring in the laundry item P.

The cabinet 10 may be made of a metal material, and may be made of a resin material such as reinforcing plastic if strength may be maintained.

The first laundry treating chamber 11 may further include an inner body 11*a* arranged inside the cabinet 10 to form the accommodating space 14. The inner body 11*a* may be made of particles discharged from the laundry item P, or may be made of a material that may be deformed by the hot-air or moisture supplied from the machine chamber 20 or may maintain strength without a chemical reaction. For example, the inner body 11*a* may be made of a styrene resin such as ABS and ASA.

The inner body 11*a* may be provided at one surface or a lower side to be communicated with the machine chamber 20 to be supplied with the hot air or moisture from the machine chamber 20, or may be provided to discharge the air to the machine chamber 20. To this end, the inner body 11*a* may include a plurality of through holes 36, 37 and 42 communicated with the machine chamber 20.

Meanwhile, the cabinet may further include a machine chamber 20 detached from the accommodating space 14. The machine chamber 20 may be provided below the accommodating space 14 to supply the heated air having a density relatively lower than the air or steam.

That is, when the air supplied to the accommodating space 14 by the machine chamber 20 is the heated art (hot air) and moisture supplied to the accommodating space 14 by the machine chamber 20 is steam, the hot air or stem may uniformly be supplied into the accommodating space 14 even without a separate ventilating unit if the machine chamber 20 is arranged below the accommodating space 14.

Meanwhile, the door assembly 100 in various embodiments described in FIGS. 13 to 19 has a plane shape having no second laundry treating chamber 12 unlike the door assembly 100 described in FIGS. 1 to 11 and is intended to open or close the opening. That is, the door assembly 100 may be provided to be rotatably coupled to the cabinet 10, thereby opening or closing the opening. The door assembly 100 may be provided to shield the front of the machine chamber 20 as well as the inner body 11*a*. As a result, the hot air or moisture supplied to the accommodating space 14 may be prevented from being discharged to the outside, and heat generated in the machine chamber 20 may be prevented from being transferred to the outside.

Since the door assembly 100 is provided to open or close the front of the inner body 11*a*, an inner circumferential surface of the inner body 11*a* and an inner surface of the door assembly 100 may form an outer circumferential surface of the accommodating space 14.

The ironing pressurizer 60 may be provided to remove wrinkles generated in the laundry item P by pressurizing the laundry item at both surfaces or form a crease intended by a user in the laundry item P. Although the ironing pressurizer is provided in the door assembly, the ironing pressurizer may be provided in the first laundry treating chamber not the door assembly. In this case, the case that the ironing pressurizer is provided in the door assembly will be described. Therefore, the door assembly includes the ironing pressurizer.

In other words, the ironing pressurizer 60 serves to perform ironing and thus allows a user not to need to additionally perform separate ironing after drying and deodorization of the laundry item P end.

The laundry item P including top and bottoms required for ironing may be pressurized by the ironing pressurizer 60.

In detail, the ironing pressurizer 60 may include a support body 61 provided in any one of the first laundry treating chamber 11 and the door assembly 100 to support the laundry item, and a pressurizing body 62 rotatably provided toward the support body 61 to pressurize the laundry item supported by the support body 61.

Although FIG. 13 illustrates that the support body 61 is provided on an inner surface of the door assembly 100, as described above, the support body 61 may be provided on an inner surface of the inner body 11*a* if it may support one surface of the laundry item.

When one surface of the laundry item is pressurized by the pressurizing body 62, the support body 61 may be provided in a plate shape such that its shape may not be deformed. In detail, the support body 61 may include a ground plate 612 provided to be in surface-contact with the laundry item P, and may further include a fixed groove 611 provided to be recessed from the ground plate 612 along a length direction to avoid a sewing line provided in the laundry item P or concentrate a pressurized force on both ends of the laundry item P.

Therefore, if the pressurizing body 62 pressurizes the support body 61, a pressure may be concentrated on the ground plate 612, whereby wrinkles of the laundry item P may effectively be removed and a crease may clearly be formed on both ends of the laundry item P. Moreover, an unintended crease may be prevented from being formed in the laundry item P due to the sewing line.

The pressurizing body 62 may rotatably be coupled to the support body 61, and may rotatably be coupled to the inner surface of the inner body 11*a* provided with the support body 61 or the inner surface of the door assembly. That is, the pressurizing body 62 may be provided in any place if it is rotated toward the support body 61 or rotated to be far away from the support body 61.

The pressurizing body 62 may rotatably be provided by a connection hinge 80 provided in at least any one of the inner body 11*a*, the door assembly 100 and one side of the support body 61.

That is, the connection hinge 80 may be provided in the support body 61, or may be provided in the inner body 11*a* provided with the support body 61 or the inner surface of the door assembly 100.

The connection hinge 80 may include a first connection hinge 81 rotatably supporting the pressurizing body 62, and a second connection hinge 82 provided below the first connection hinge 81 to rotatably support the pressurizing body.

The pressurizing body 62 may further include a pressurizing plate 622 rotatably provided toward the support body 61, and a curvature groove 621 provided to be recessed a length direction of the pressurizing plate 622 to avoid a sewing line provided in the laundry item P or concentrate a pressurized force on both ends of the laundry item P.

Therefore, the pressurizing body 62 may be rotated toward the support body 61 to pressurize one surface of the laundry item P, and the support body 61 may pressurize the other surface of the laundry item P by action/counteraction.

Meanwhile, the ironing pressurizer 60 may further include an ironing partition unit 63 rotatably provided toward the support body and the pressurizing body between the support body 61 and the pressurizing body 62.

In detail, the ironing partition unit 63 may include an ironing partition body 631 rotatably provided between the support body 61 and the pressurizing body 62. The ironing partition body 631 may be provided with an area corresponding to an area of the pressurizing body 62 and the support body 61. Therefore, the ironing partition unit 63 may fully pressurize the laundry item arranged in any one of the pressurizing body 62, the ironing partition body 631 and the support body 61.

The ironing partition body 631 may rotatably be coupled to the first connection hinge 81 and the second connection hinge 82 and thus provided to be rotated separately from the pressurizing body 62 or provided to be rotated in a single body with the pressurizing body 62.

The ironing partition body 631 may be provided to be independently rotated toward the support body 61, or may be pressurized together with the pressurizing body 62 when the pressurizing body 62 is rotated toward the support body 61 and thus rotated toward the support body 61.

Figure 14:
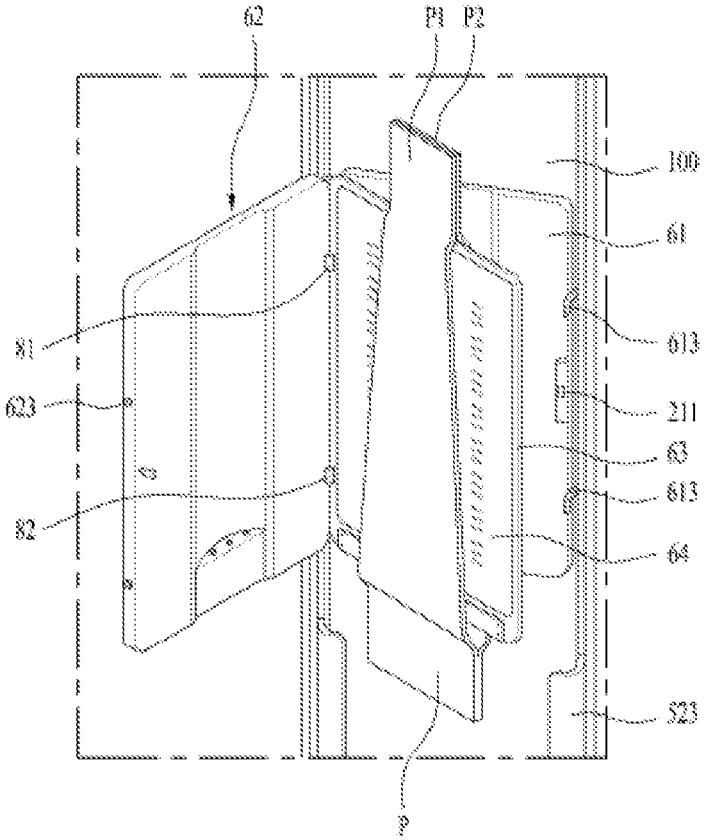
FIG. 14 illustrates that a laundry item is held on an ironing pressurizer of the present disclosure.

FIG. 14 illustrates an aspect that a laundry item P is provided in the ironing pressurizer 60 and pressurized.

Referring to FIG. 14, in the case that the laundry item is provided as bottoms and divided into a first part P worn on a left leg of a user and a second part P2 worn on a right leg of the user, any one of the first part and the second part may be provided to be pressurized in the pressurizing body 62 and the ironing partition body 631, and the other one of the first part and the second part may be provided to be pressurized in the ironing partition unit 63 and the support body 61.

For example, the first part P1 and the second part P2 of the laundry item P may be arranged at a lower end or an upper end of the ironing partition body 631, wherein the first part P1 may be supported on one surface provided toward the pressurizing body 62 of the ironing partition body 631 and the second part P2 may divisionally be supported on the other surface provided toward the support body 61.

At this time, the first part P1 and the second part P2 may be fixed by being overlapped with each other above or below the ironing partition body 631. Therefore, the first part P1 and the second part P2 of the laundry item may be unfolded by self-load, and may not be provided by being overlapped with each other. As a result, each of the first part P1 and the second part P2 of the laundry item may exactly be pressurized to remove wrinkles, or a crease may exactly be formed at both sides.

Meanwhile, an upkeep belt 632 may further be provided to be protruded on both surfaces or one surface of the ironing partition body 631.

The upkeep belt 632 may prevent the support body 61 and the pressurizing body 62 from being excessively adhered to each other, or may prevent the laundry item P from being displaced when the laundry item P is pressurized by the pressurizing body 62 or the ironing partition unit 63.

To this end, the upkeep belt 632 may be made of a material having a frictional force greater than that of the ironing partition body 631 or may be made of another material having a buffering force.

Meanwhile, since the ironing partition unit 63 having a certain thickness and the laundry item are arranged between the support body 61 and the pressurizing body 62, even though the pressurizing body 62 pressurizes the laundry item, the pressurizing body 62 may be rotated in an opposite direction of the support body 61 by counteraction.

Therefore, in order to avoid this, the laundry treating apparatus 1000 of the present disclosure may further include a coupling hook 613 provided in the support body 61 to fix the pressurizing body, and a hook coupling unit 623 provided in the pressurizing body and fixed to the coupling hook.

In one embodiment, the hook coupling unit 623 may include a hook protrusion 623 provided to be protruded on a circumferential surface of the pressurizing plate 622, and the coupling hook 613 may be provided in a hook shape to be fastened to the hook protrusion 623.

Also, unlike the shown example, the coupling hook 613 may be provided to be inserted and fastened to the hook coupling unit 623, and if the support body 61 is coupled to the pressurizing body 62 such that the pressurizing body 62 may pressurize the ironing partition body 63 and the support body 61, the coupling hook 613 may be provided in any shape and structure.

Although FIG. 14 illustrates that the laundry item P is provided as one corresponding to bottoms, this is only exemplary, and a plurality of laundry items may be provided in the ironing pressurizer 60. In other words, if the plurality of laundry items are provided, any one of the laundry items may be arranged between the ironing partition unit 63 and the pressurizing body 62, and the other one laundry item may be arranged between the ironing partition unit 63 and the support body 61. Also, in the embodiment which will be described later, a plurality of ironing partition units may be provided such that the laundry items may respectively be arranged in the ironing partition units.

As a result, if the pressurizing body 62 is rotated toward the support body 61, the pressurizing body 62 may pressurize any one of the laundry items through the ironing partition body 631 and the ironing partition body 631 may pressurize the other one of the laundry items through the support body 61.

Therefore, the plurality of laundry items may fully be pressurized by one ironing pressurizer 60 to remove wrinkles or form a crease.

Moreover, when the laundry item is provided as top, the laundry item may be inserted into the outer circumferential surface of the ironing partition body 631 and fixed to accommodate the ironing partition body 631, whereby one surface and the other surface of the laundry item may be pressurized by the pressurizing body 62 and the support body 61.

Meanwhile, if the ironing partition unit 63 is provided between the support body 61 and the pressurizing body 62, it may be difficult to supply moisture or the hot air supplied from the machine chamber 20 to the laundry item. Therefore, the ironing pressurizer 60 may need a separate element that may supply heat or steam to the laundry item P.

Meanwhile, the support body 61 may include a coupling unit 311 that may detachably couple the ironing partition body 631. The coupling unit 311 may be provided in a hook type into which the outer circumferential surface of the ironing partition body 631 is partially inserted, or may be provided such that fastening units provided in the pressurizing body 62 may be coupled thereto at the same time.

Figure 15:
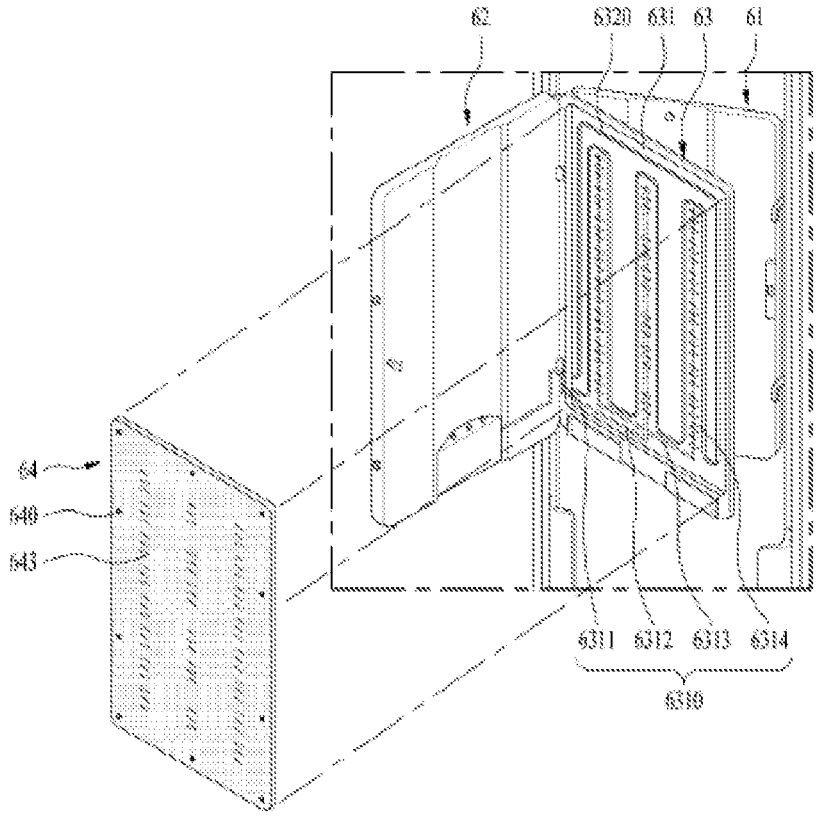
FIG. 15 illustrates one embodiment of a heating unit provided in in an ironing pressurizer of the present disclosure.

FIG. 15 illustrates a structure that heat or steam may separately be supplied to the ironing pressurizer 60. Referring to FIG. 15, the ironing partition unit 63 of the present disclosure may further include a heating unit 64 provided in any one of both surfaces of the ironing partition body 631 and provided to supply heat to the laundry item.

The heating unit 64 may be provided to effectively remove wrinkles or effectively generate a crease by supplying heat energy to the laundry item pressurized among the ironing partition unit 63, the support body 61 and the pressurizing body 62.

The heating unit 64 may include a heating body 640 provided in at least any one of both surfaces of the ironing partition body 631 and exposed to the outside, and a hot wire 6320 provided in any one of the ironing partition body 631 and the heating body 640 and provided to heat the heating body 640.

The heating body 640 may be made of a conductor or metal material to transfer heat, and the hot wire 6320 may be provided to be heated by electric energy to transfer heat to the heating body 640.

The heating body 640 may detachably be coupled to both surfaces of the ironing partition body 631 to form an exposed surface of the ironing partition body 631. That is, the heating body coupled to one of both surfaces of the ironing partition body 631, which is close to the inner side of the door assembly 100, becomes (1-1)th heating body 6411, and the heating body provided on the other surface of the ironing partition body 631 becomes a second heating body 6412.

If the heating body and the fixed body are made of the same material, the heating body 640 may be provided in a single body with the ironing partition body 631.

The hot wire 6320 may be provided to be attached to a rear surface of the heating body 640 but may favorably be provided in the ironing partition body 631 in view of safety. In other words, the hot wire 6320 may be provided to be spaced apart from the ironing partition body 631 at a certain distance from the heating body 640 to indirectly heat the heating body 640.

The hot wire 6320 may be provided to be supplied with electric energy from the cabinet 10 or the machine chamber 20 of the laundry treating apparatus of the present disclosure, and may be connected with the outside of the ironing pressurizer 60 through the first connection hinge 81 or the second connection hinge 82. The hot wire 6320 may uniformly be provided on both surfaces of the ironing partition body 631 to reciprocate in a height direction and a width direction several times such that heat may uniformly be supplied to one surface of the heating body 640.

Meanwhile, the heating unit 64 may include a supply path 6310 provided in any one of the ironing partition body 631 and the heating body 640, and a discharge hole 643 provided to discharge the steam to the laundry item by passing through the heating body 640.

The supply path 6310 may be provided to be supplied with water such that the water may be heated by the hot wire 6320 and discharged to the discharge hole 643, or may be provided as a path to which the steam or mist is directly supplied.

The supply path 6310 may be provided in a plural number to be spaced apart at a certain distance along a height direction or a width direction of the ironing partition body 631, and the discharge hole 643 may be provided along an extension direction of the supply path 6310. As a result, steam may uniformly be supplied to the laundry item P through the discharge hole 643.

The heating unit 64 may include any one of the supply path 6310 and the hot wire 6320, or may include both the supply path 6310 and the hot wire 6320.

Meanwhile, if the heating unit 64 is provided with both the supply path 6310 and the hot wire 6320, the hot wire 6320 may be provided outside the supply path 6310 so as not to interfere with the supply path 6310. Also, the hot wire 6320 may be provide along the outside of the supply path 6310.

Meanwhile, since the ironing partition unit 63 is rotatably provided in the first laundry treating chamber 11 or the door assembly 100, an arrangement area of a path for supplying steam to the supply path 6310 may be restricted.

The supply path 6310 may include a main path 6312 inserted into the ironing partition body 631 or provided on a surface of the ironing partition body 631, a divergence path 6313 provided to be diverged into a plurality of paths in a height direction or a width direction of the ironing partition body 631, and spray paths 6314 extended from the divergence paths 6313 in the same direction to supply steam.

At this time, the plurality of spray paths 6314 is preferably provided in a height direction to facilitate movement of steam because the steam is lightweight, and is preferably provided to be spaced apart from one another in a width direction to spray steam to many areas.

Therefore, if steam, moisture or water is supplied to the main path 6312, steam may be distributed along the spray paths 6314 and uniformly sprayed to the ironing partition body 631.

The supply path 6310 may further include a communication path 6311 provided to be communicated with an auxiliary steam supply unit 85 provided outside the ironing partition body 631 to transfer water or steam to the main path 6312.

Meanwhile, the hot wire 6320 may be provided to be communicated with any one of the first connection hinge 81 and the second connection hinge 82, and the main path 6311 may be provided to be communicated with the other one of the first connection hinge 81 and the second connection hinge 82 and thus may not be overlapped with the other one of the first connection hinge 81 and the second connection hinge 82.

To this end, passage units 811 and 812 through which the hot wire or the main path 6311 may pass or communicate may be provided in the first connection hinge 81 and the second connection hinge 82.

Figure 16:
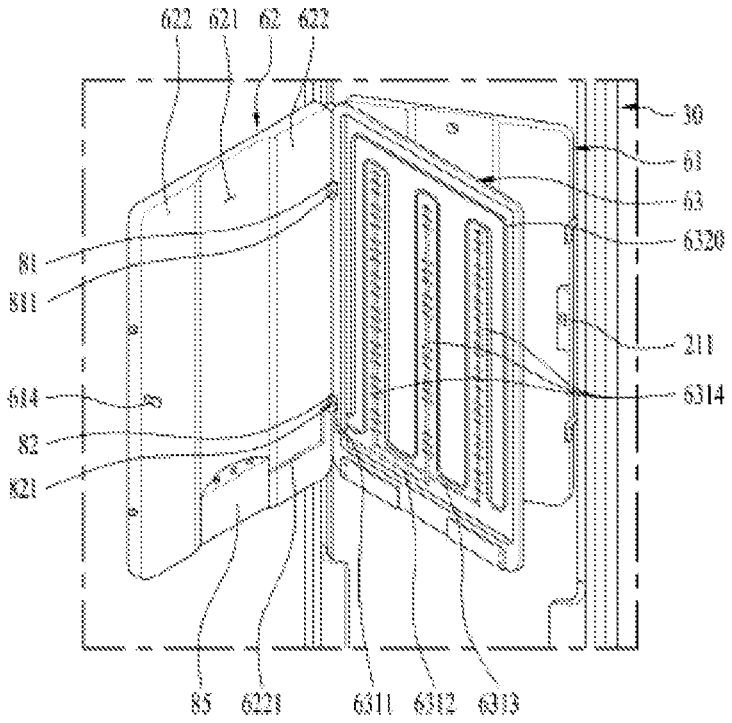
FIG. 16 illustrates one embodiment of a path structure of a heating unit of the present disclosure.

FIG. 16 illustrates a structure that the auxiliary steam supply unit 85 is provided to supply steam.

The auxiliary steam supply unit 85 may be provided in an area of the cabinet, the machine chamber 20, the door and the pressurizer, where a user may easily approach.

The auxiliary steam supply unit 85 may be provided in at least any one of the cabinet, the machine chamber 20, the door and the pressurizer. Since the laundry treating apparatus 1000 is not likely to be connected to an outer water supply source, the auxiliary steam supply unit 85 is preferably provided in any one of the cabinet, the machine chamber 20, the door and the pressurizer to be detached therefrom.

Also, since it is favorable that the auxiliary steam supply unit 85 is provided in an area closest to the supply path 6310, the auxiliary steam supply unit 85 is preferably provided in the ironing partition unit 63. Since the pressurizing body 62 is first exposed to a user, the auxiliary steam supply unit 85 is preferably provided in the pressurizing body 62.

If the auxiliary steam supply unit 85 is detachably provided in the pressurizing body 62, the pressurizing body 62 may further include a connection path 6221 provided to communicate the auxiliary steam supply unit 85 with the connection hinge 80.

The connection path 6221 may be provided in a plate shape that may discharge moisture or steam supplied from the auxiliary steam supply unit 85, and may be inserted into the pressurizing body 62.

Therefore, the connection path 6221 and the communication path 6311 are provided to be communicated with each other through the second connection hinge 82, whereby moisture or steam generated from the auxiliary steam supply unit 85 may completely be discharged to the discharge hole 643.

Meanwhile, the supply path 6310 may be provided to be inserted into the ironing partition body 631, and the ironing partition body 631 may include a plurality of through holes provided to be communicated with the discharge hole 643 of the heating unit 64.

Therefore, the supply path 6310 is provided inside the ironing partition body 631 without being provided on both surfaces of the ironing partition body 631, whereby a thickness of the ironing partition body 631 may be reduced. Also, it is advantageous that steam may be supplied to both surfaces of the ironing partition body 631 through one supply path 6310.

Figure 17:
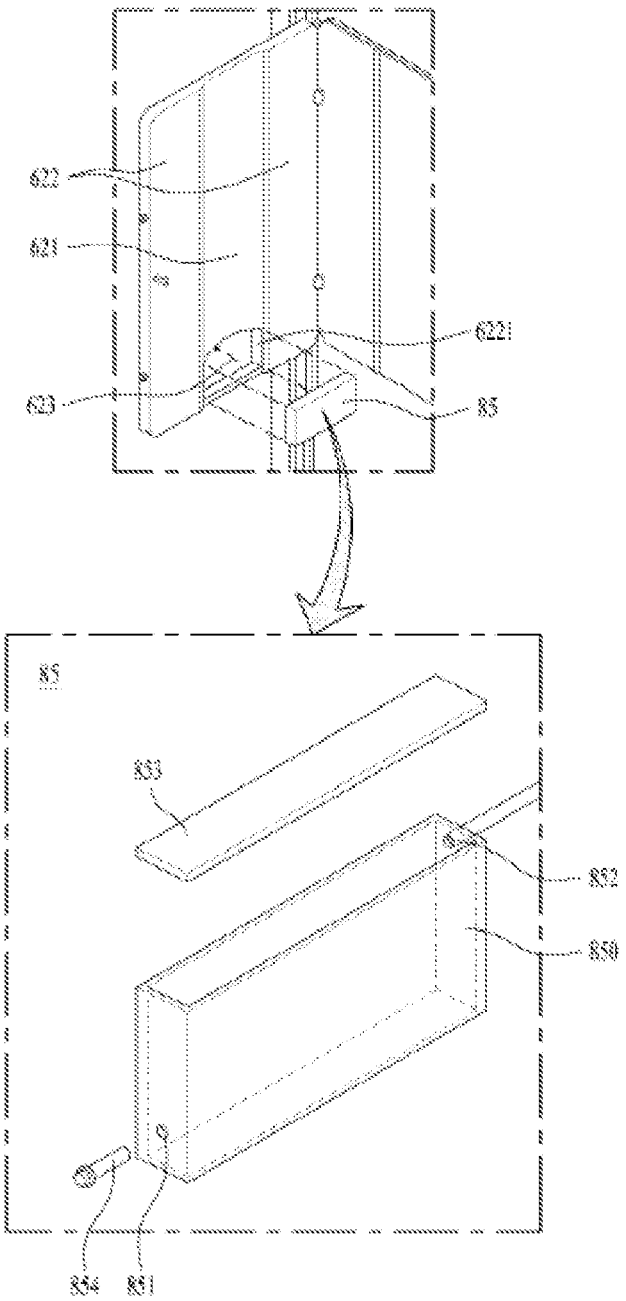
FIG. 17 illustrates one embodiment of a moisture supply structure of a heating unit of the present disclosure.

FIG. 17 illustrates one embodiment of the auxiliary steam supply unit 85. As described above, the auxiliary steam supply unit 85 may detachably be provided in the pressurizing body 62.

The auxiliary steam supply unit 85 may include an auxiliary water tank 850 detachably provided in any one of the pressurizer to accommodate water therein, an auxiliary heater 854 heating water of the auxiliary water tank 850 to generate steam, and a discharge outlet 852 communicating the auxiliary water tank 850 with the supply path 6310 to discharge steam.

The auxiliary water tank 850 may be provided in a case shape having a certain volume, and may include an opened surface thereon to be easily supplied with water or facilitate washing, and may further include a cover 853 provided to shield the opened surface.

Also, the auxiliary water tank 850 may include a heater insertion hole 811 into which the auxiliary heater 854 is inserted and fixed, at one side, and the auxiliary heater 854 may be provided to be fixed to the heater insertion hole 811 to heat water stored in the auxiliary water tank 850, thereby forming steam.

The discharge outlet 852 may be provided at an upper portion of one side of the auxiliary water tank 850 to completely discharge steam having a relatively low density, or may be provided to be communicated with the connection path 6221.

The pressurizing body 62 may further include an accommodating unit 623 provided to accommodate the auxiliary water tank 850. Also, when the auxiliary water tank 850 is provided in the accommodating unit 623, an exposed surface of the auxiliary water tank 850 and one surface of the pressurizing body 62 may be provided in parallel with each other.

Therefore, if water is supplied to the auxiliary water tank 850, steam may be supplied to the laundry item P through the heating unit 64.

Meanwhile, unlike the shown example, the heating unit 64 may be communicated with the machine chamber 20 or the auxiliary water tank 850 and thus directly supplied with the hot air or moisture from the machine chamber 20 or the auxiliary water tank 850 to discharge the hot air or moisture toward the pressurizing body 62 and the support body 61.

In other words, the heating unit 64 may be provided as a discharge hole 643 provided in a single body with the ironing partition body 631 to discharge the hot air and moisture.

A path communicated with the machine chamber 20 may be provided in the first connection hinge 81 and the second connection hinge 82, and a supply path communicated with the path to supply the hot air or moisture to the heating unit 64 may be provided in the ironing partition body 631.

If the heating unit 64 is communicated with the machine chamber 20, the hot air or moisture of the machine chamber 20 may be supplied to the heating unit 64 when being supplied to the accommodating space 14.

Unlike this case, the steam generator 41 of the machine chamber 20 may be provided to be communicated with the ironing partition unit 63 to supply steam.

That is, in the same manner as FIG. 5, the steam generator 41 may be provided to be connected with a separate steam supply path provided to be communicated with the ironing partition unit 63 through the connection hinge 80, and the steam supply pipe 417 may be provided to be communicated with the ironing partition unit 63 through passage units 811 and 821 provided in the connection hinge 80.

Therefore, the steam generated from the steam generator 41 may directly be transferred to the ironing partition unit 63 and then supplied to the laundry item P. At this time, the hot wire 6320 and the auxiliary steam supply unit 85 may be omitted.

Figure 18:
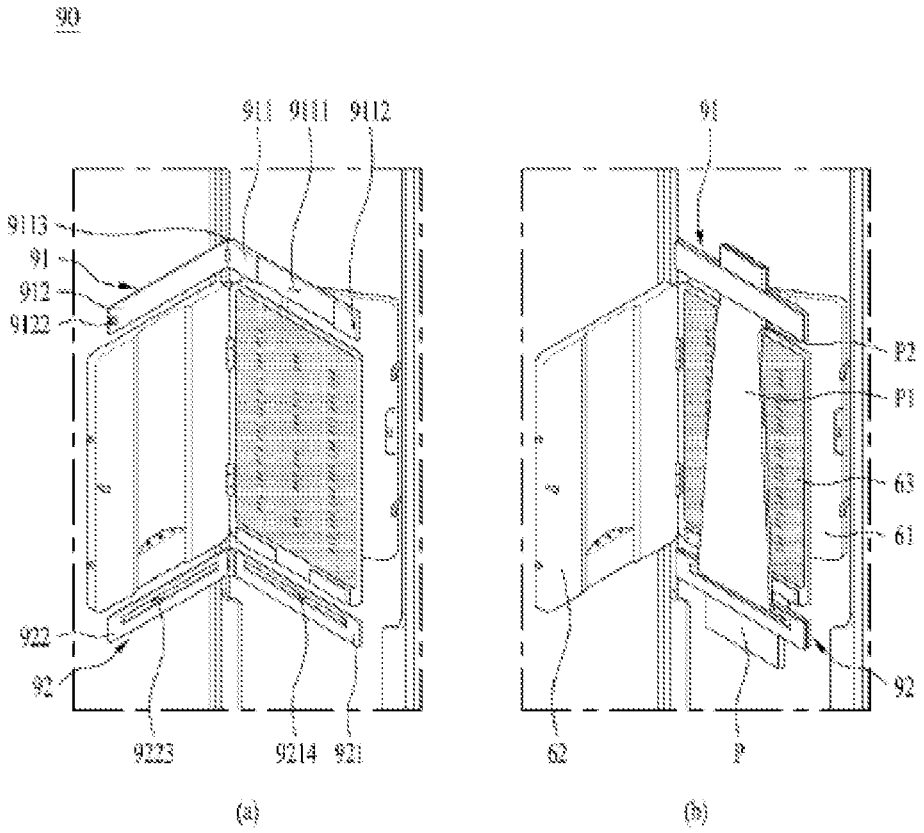
FIG. 18 illustrates a structure of a hanging unit for hanging a laundry item on an ironing pressurizer of the present disclosure.

FIG. 18 illustrates a structure of a hanging unit for hanging a laundry item on the ironing pressurizer 60.

FIG. 18(*a*) illustrates that the laundry item is detached from the ironing pressurizer 60, and FIG. 18(*b*) illustrates that the laundry item is fixed to the ironing pressurizer 60.

The laundry treating apparatus 1000 of the present disclosure may further include a hanging unit 90 provided in any one of an upper portion and a lower portion of the ironing pressurizer 60 to hang or fix the laundry item. A position of the hanging unit 90 may be arranged in one of the support body 61, the pressurizing body 62 and the ironing partition unit 63. That is, the position of the hanging unit 90 may be arranged in an upper portion or a lower portion of one of the support body 61, the pressurizing body 62 and the ironing partition unit 63.

The hanging unit 90 may include hanging bodies 911 and 921 provided in any one of the upper portion and the lower portion of the pressurizer to support the laundry item, and fixing bodies 912 and 922 coupled to the hanging bodies to fix the laundry item to the hanging bodies.

The hanging bodies 911 and 921 may fix the laundry item in a tense state to prevent the laundry item from being wrinkled or displaced when the laundry item is pressurized by the pressurizing unit 90.

At this time, in a state that the partition unit 93 is rotated, if the hanging unit 90 is fixed, the laundry item may be damaged. Therefore, the hanging bodies 911 and 921 may be provided to be rotated to correspond to the partition unit 93.

Also, the fixing bodies 912 and 922 may rotatably be coupled to the hanging bodies 911 and 921 and provided such that the laundry item may fixedly be inserted into the fixing bodies 912 and 922 and the hanging bodies 911 and 921.

The hanging bodies 911 and 921 may be coupled with the fixing bodies 912 and 922 by hook coupling to prevent the laundry item P from being randomly detached from the bodies. For example, a hanging unit hook coupling unit 9112 may be provided in the hanging bodies 911 and 921, and the fixing bodies 912 and 922 may be provided with a hanging unit coupling hook 9122 to which the coupling hook is coupled.

Meanwhile, the hanging unit 90 may be provided on only the upper portion of the ironing pressurizer 60 to fix the laundry item P, whereby the laundry item P may be tensed by self-load.

However, if load of the ironing pressurizer 60 pressurizing the laundry item P is relatively great or the ironing pressurizer 60 pressurizes the laundry item P from one side to the other side, the laundry item P may be displaced or wrinkled.

Therefore, the hanging unit 90 may be provided at both the upper and lower portions of the ironing pressurizer 60 to provide sufficient tension to the laundry item P, whereby the laundry item P may be prevented from being wrinkled or displaced.

Referring to FIG. 18(*a*), the hanging unit 90 may include a first hanging unit 91 provided at the upper portion of the ironing pressurizer 60, and a second hanging unit 92 provided at the lower portion of the ironing pressurizer 60.

The first hanging unit 91 and the second hanging unit 92 may be provided together to correspond to the ironing partition unit 63.

The first hanging unit 91 may include a first hanging body 911 rotatably provided at the upper portion of the ironing partition unit 63, and a first fixing body 912 rotatably coupled to the first hanging body 912 to fix the laundry item.

The first hanging body 911 may be provided in a plate shape having a length longer than a width, the first fixing body 912 may rotatably be coupled to the first hanging body 911 and its free end may detachably be coupled to the first hanging body 911.

The first hanging body 911 may further include an accommodating groove 9111 provided to have one curved surface, thereby accommodating the laundry item. Therefore, the laundry item may be prevented from being excessively pressurized.

Meanwhile, the second hanging unit 92 may include a second hanging body 921 rotatably provided at the lower portion of the ironing partition unit 63, and a second fixing body 922 rotatably coupled to the second hanging body 922 to fix the laundry item.

The second hanging body 921 may include a first through slit 9214 into which the first part P of the laundry item is inserted to pass therethrough, and the second fixing body 922 may include a second through slit 9223 into which the second part is inserted to pass therethrough.

Therefore, the first part P1 and the second part P2 of the laundry item may be inserted into the first through slit and the second through slit and guided by being partitioned into both surfaces of the partition unit 93.

Therefore, referring to FIG. 18(*b*), the first part P1 of the laundry item P may be inserted into the second through slit 9223 and guided between one surface of the ironing partition unit 63 and the pressurizing body 62, and the second part P2 of the laundry item P may be inserted into the first through slit 9214 and guided between the other surface of the ironing partition unit 63 and the support body 61.

Also, the first part P1 and the second part P2 of the laundry item may be overlapped with each other at the upper portion of the ironing pressurizer 60 and fixedly inserted into the first hanging body 911 and the first fixing body 912.

At this time, the first part P1 and the second part P2 of the laundry item may be fixedly inserted into the first hanging body 911 and the first fixing body 912 in a state that they are tightly pulled.

Unlike the shown example, the first hanging unit 91 may be provided with a through slit, and the second hanging unit 92 may be provided with an accommodating groove. Therefore, a user may control a hanging direction of the laundry item P if necessary.

Figure 19:
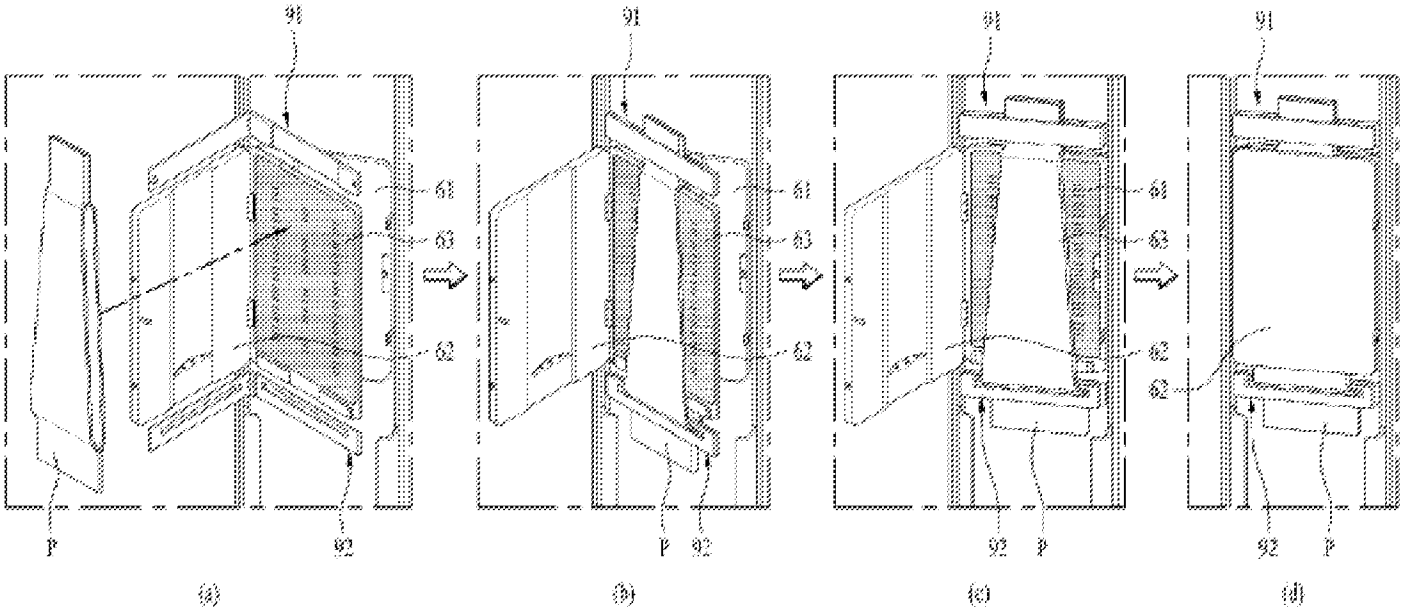
FIG. 19 illustrates a procedure of hanging a laundry item on an ironing pressurizer and a hanging unit of the present disclosure.

FIG. 19 illustrates a procedure of hanging a laundry item P in the laundry treating apparatus 1000 according to one embodiment of the present disclosure.

Referring to FIG. 19(*a*), the first fixing body 921 and the first hanging body 911 may be detached from each other, and the second fixing body 922 and the second hanging body 921 may be detached from each other. Also, the pressurizing body 62, the support body 61 and the ironing partition unit 63 may be detached from one another.

Referring to FIG. 19(*b*), the first part P1 and the second part P2 of the laundry item P are inserted into the through slits provided in the second hanging body 921 and the second fixing body 921, whereby the first part P1 is arranged between the ironing partition unit 63 and the pressurizing body 62, and the second part P2 is arranged between the ironing partition unit 63 and the support body 61.

Afterwards, free ends of the first part P1 and the second part P2 of the laundry item P may be overlapped with each other and tightly pulled. Then, the first part P1 and the second part P2 of the laundry item P are fixed to the first hanging body 911 and the second fixing body 921 in a tense state.

Referring to FIG. 19(*c*), the first hanging part 91, the second hanging part 92 and the ironing partition unit 63 are rotated toward the support body 61. At this time, the support body 61 and the ironing partition unit 63 are coupled to each other to be prevented from being detached from each other.

Referring to FIG. 19(*d*), the pressurizing body 62 is rotated by the support body 61 to pressurize the ironing pressurizing unit 63. Afterwards, the pressurizing body 62 and the support body 61 are coupled to each other to be prevented from being randomly detached from each other.

As a result, the first part P1 and the second part P2 of the laundry item P are all pressurized. At this time, if heat and steam are supplied from the heating unit 64, wrinkles of the first part P1 and the second part P2 of the laundry item P are removed, and a crease is formed.

Figure 20:
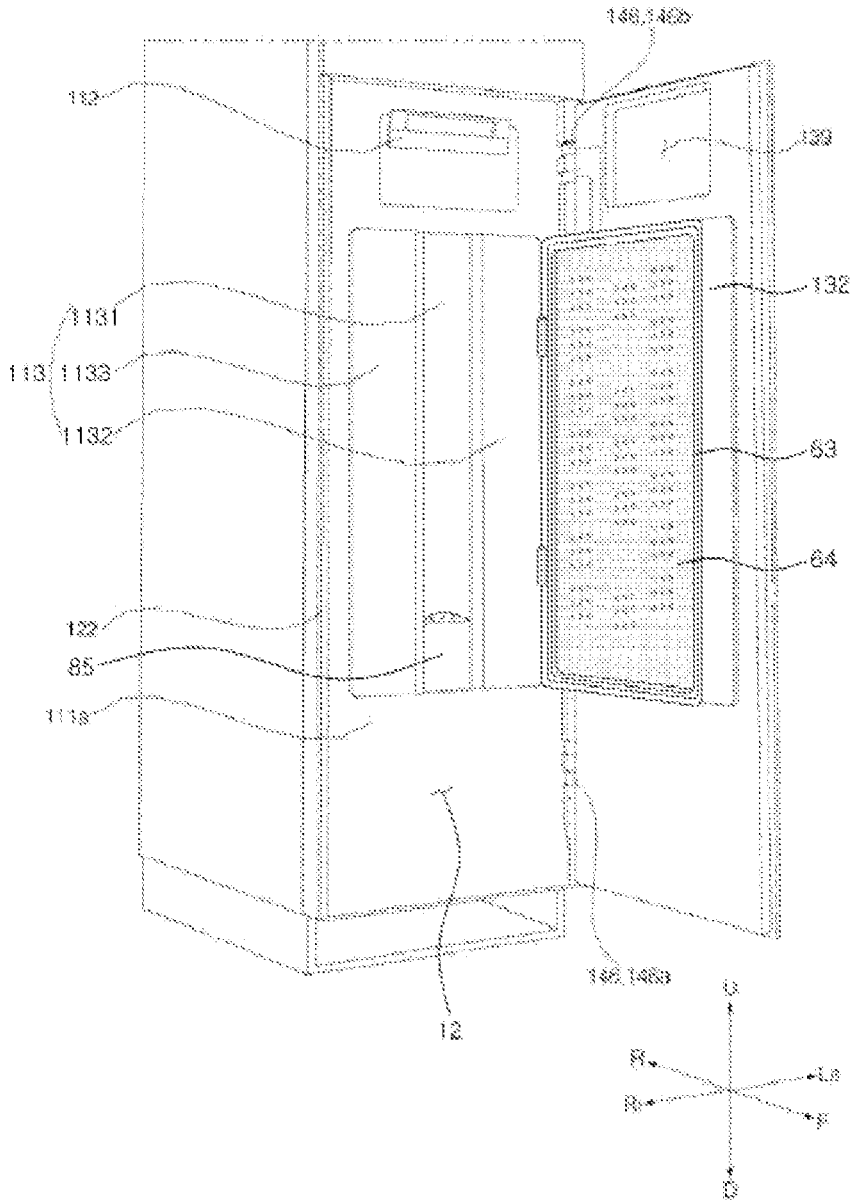
FIG. 20 illustrates arrangement of a base plate, a press plate and an ironing partition unit provided in a door assembly according to one embodiment of the present disclosure.

FIG. 20 illustrates another embodiment of the present disclosure. That is, an ironing partition unit 63 is additionally provided in the second laundry treating chamber 12 of the door assembly 100 of a door in door type. As described above with reference to FIGS. 1 and 4, the door assembly 100 forms the second laundry treating chamber 12 that may remove a crease by pressurizing laundry therein. The door assembly 100 according to this embodiment includes an assembly door 130 that opens or closes the second laundry treating chamber 12. The assembly door 130 according to this embodiment may be arranged in a front direction F of the door assembly 100 to open or close the second laundry treating chamber 12 formed inside the door assembly 100 in the front direction F.

The second laundry treating chamber 12 is arranged inside the door assembly 100. The second laundry treating chamber 12 may have a shape opened toward a front direction from the door assembly 100, and may be disconnected from the outside by the assembly door 130. The assembly door 130 may serve as a door that opens or closes the inner space of the second laundry treating chamber 12. Therefore, the second laundry treating chamber 12 may only be opened or closed by the assembly door 130 even without opening or closing the first laundry treating chamber 11 through the assembly housing 110. This is referred to as a door in door type.

A fixing member 114 fixing laundry to hang the laundry toward a downward side D, a base plate 113 supporting the laundry arranged therein, and a press plate 132 tightly attached to the base plate 113 to pressurize the laundry arranged between the base plate 113 and the press plate 132 are arranged in the second laundry treating chamber 12. The ironing partition unit 63 is rotatably coupled between the plates. Although the ironing partition unit is shown to be rotatably coupled to the base plate 113, this is only exemplary. If the base plate 113, the press plate 132 and the ironing partition unit 63 may be coupled to one another by rotation to correspond to one another, the ironing partition unit 63 may be coupled to any plate. That is, the ironing partition unit 63 may be coupled with the base plate 113 by a hinge, or may be coupled with the press plate 132 by a hinge. Also, the ironing partition unit 63 may rotatably be coupled to the assembly door 130 or the door assembly 100.

FIG. 20 illustrates a structure that the auxiliary steam supply unit 85 is provided to supply steam in the same manner as FIG. 16. Preferably, the auxiliary steam supply unit 85 is detachably provided in at least any one of the cabinet 10, the machine chamber 20, and the door assembly 100. That is, in the same manner as FIG. 14, the auxiliary steam supply unit 85 may be provided in the second base plate 134 to supply steam to the first ironing partition unit 6301 and the second ironing partition unit 6302 through the communication path. The hot wire may be provided along the outside of the supply path and thus prevented from interfering with the supply path for steam supply to each ironing partition unit. Also, the door assembly may include a connection hinge rotatably coupling the ironing partition unit with the support body, and a passage unit provided in the connection hinge to pass the hot wire or the supply path therethrough.

Meanwhile, unlike this case, the steam generator 41 of the machine chamber 20 may be provided to be communicated with the ironing partition unit 63, thereby supplying steam.

That is, in the same manner as FIG. 5, the steam generator 41 may be provided to be connected with a separate steam supply path provided to be communicated with the ironing partition unit through the connection hinge 80 by passing through the cabinet hinge unit 144 and the assembly hinge unit 146, and the steam supply pipe 417 may be provided to be diverged and communicated with the ironing partition unit 6301 through the passage units 811 and 821 provided in the connection hinge 80. Referring to the aforementioned drawings, the following process will be apparent to those skilled in the art and thus its description will be omitted.

Figure 21:
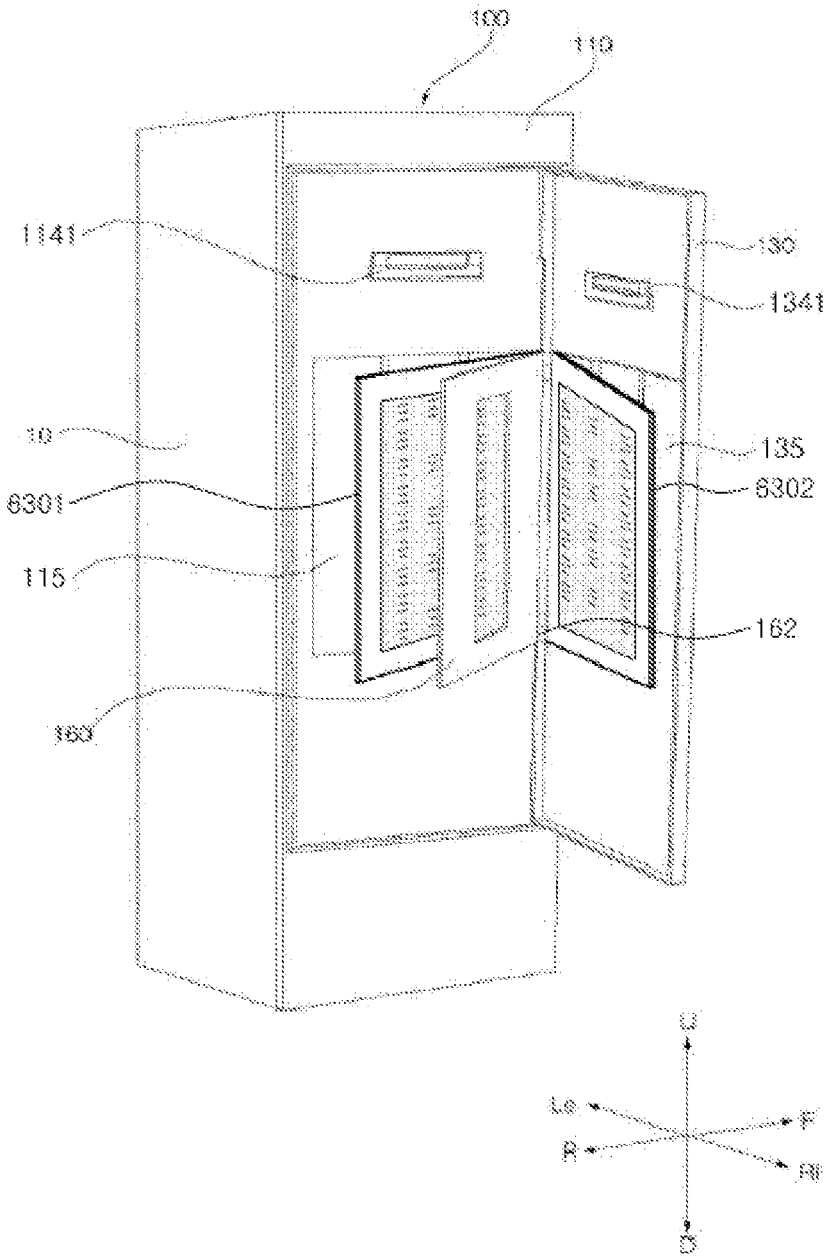
FIG. 21 illustrates arrangement of a base plate, a press plate, a partition plate and a plurality of ironing partition units provided in a door assembly according to another embodiment of the present disclosure.

FIG. 21 illustrates another embodiment of the present disclosure. That is, a plurality of ironing partition units 63 are additionally provided in the second laundry treating chamber 12 of the door assembly 100 of a door in door type. Therefore, several laundry items may be pressurized, heated and supplied with steam at the same time. FIG. 21 illustrates two ironing partition units and one partition plate 160. Also, a first fixing member 1141 fixing a laundry item and a first base plate 115 pressurizing the laundry item fixed to the assembly housing 110 together with the partition plate 160 are arranged at the inner side 111*a* of the assembly housing 110.

The first base plate 115 includes a first base fixed plate 116 fixed to the assembly housing 110, and first base elastic plates 116*a* and 116*b* formed to be extended from the first base fixed plate 116 and formed to be more spaced apart from the inner side 111*a* of the assembly housing 110 than the first base fixed plate 116, providing an elastic force to laundry.

A second fixing member 1341 fixing laundry and a second base plate 135 pressurizing the laundry fixed to the assembly door 130 together with the partition plate 160 are arranged at the inner side 131 of the assembly door 130 according to this embodiment.

The second base plate 135 includes a second base fixed plate 136 fixed to the assembly door 130, and second base elastic plates 136*a* and 136*b* formed to be extended from the second base fixed plate 136 and formed to be more spaced apart from the inner side 131 of the assembly door 130 than the second base fixed plate 136, providing an elastic force to laundry.

Also, the first ironing partition unit 6301 is provided between the first base plate 115 and the partition plate 160, and the second ironing partition plate 6302 is provided between the partition plate 160 and the second base plate 135. Also, the first ironing partition unit 6301 and the second ironing partition unit 6302 are rotatably coupled with each other by a hinge. That is, the first ironing partition unit 6301, the second ironing partition unit 6302 and the partition plate 160 may rotatably be coupled with the assembly hinge. Alternatively, unlike this example, the first ironing partition unit may be coupled with the first base plate 115 by a hinge or the second ironing partition unit may be coupled with the second base plate 116 by a hinge. That is, if the first ironing partition unit and the second ironing partition unit may be coupled to each other by rotation to correspond to each other, the ironing partition units may be coupled to each other even by any coupling.

Also, in the same manner as FIG. 16, the auxiliary steam supply unit may be provided. However, the following process will be apparent to those skilled in the art through FIG. 16 and thus its description will be omitted.

It will be apparent to those skilled in the art that the present specification can be embodied in other specific forms without departing from the spirit and essential characteristics of the specification. Thus, the above embodiments are to be considered in all respects as illustrative and not restrictive. The scope of the specification should be determined by reasonable interpretation of the appended claims and all change which comes within the equivalent scope of the specification are included in the scope of the specification.

The invention claimed is:

1. A laundry treating apparatus comprising:
- a cabinet having an opening in a front direction;
- a door assembly opening or closing the opening;
- a first laundry treating chamber provided inside the cabinet, providing a space for accommodating laundry, and communicated with an outside of the cabinet through the opening; and
- a machine chamber that is communicated with the first laundry treating chamber and receives at least one of a steam supply unit supplying steam to the first laundry treating chamber and an air supply unit circulating air, wherein the door assembly includes:
- a support body supporting the laundry at an inner side of the door assembly,
- a pressurizing body rotatably provided toward the support body to pressurize the laundry, and
- an ironing partition unit rotatably provided between the support body and the pressurizing body toward the support body or the pressurizing body to pressurize the laundry at both sides, and wherein the ironing partition unit includes:
- an ironing partition body rotatably provided between the support body and the pressurizing body, wherein an area of the ironing partition body corresponds to an area of the pressurizing body or the support body.

2. The laundry treating apparatus of claim 1, wherein the door assembly further includes:
- a coupling hook provided in the support body to fix the pressurizing body; and
- a hook coupling unit provided in the pressurizing body and fixed to the coupling hook, and
- wherein the door assembly is configured to prevent the support body and the pressurizing body from being spaced part from the ironing partition unit.

3. The laundry treating apparatus of claim 1, wherein the ironing partition unit further includes a heating unit provided in any one of both surfaces of the ironing partition body to supply heat to the laundry.

4. The laundry treating apparatus of claim 1, wherein the ironing partition unit is configured to communicate with the machine chamber to discharge hot air or moisture supplied from the machine chamber.

5. The laundry treating apparatus of claim 1, wherein the door assembly is configured to prevent the support body and the pressurizing body from being spaced part from the ironing partition unit.

6. The laundry treating apparatus of claim 1, wherein the area of the ironing partition body corresponds to the area of each of the pressurizing body and the support body.

7. A laundry treating apparatus comprising:
- a cabinet having an opening in a front direction;
- a door assembly opening or closing the opening;
- a first laundry treating chamber provided inside the cabinet, providing a space for accommodating laundry, and communicated with an outside of the cabinet through the opening; and a machine chamber that is communicated with the first laundry treating chamber and receives at least one of a steam supply unit supplying steam to the first laundry treating chamber and an air supply unit circulating air, wherein the door assembly includes:

a support body supporting the laundry at an inner side of the door assembly, a pressurizing body rotatably provided toward the support body to pressurize the laundry, and an ironing partition unit rotatably provided between the support body and the pressurizing body toward the support body or the pressurizing body to pressurize the laundry at both sides, and wherein the ironing partition unit includes:

an ironing partition body rotatably provided between the support body and the pressurizing body, and a heating unit provided in any one of both surfaces of the ironing partition body to supply heat to the laundry.

8. The laundry treating apparatus of claim 7, wherein the heating unit includes:

a heating body provided to be exposed to the outside in at least any one of both surfaces of the ironing partition body; and a hot wire provided in any one of the ironing partition body and the heating body to heat the heating body.

9. The laundry treating apparatus of claim 7, wherein the heating unit includes:

a heating body provided to be exposed to the outside in at least any one of both surfaces of the ironing partition body;

a supply path provided in any one of the ironing partition body and the heating body and thus supplied with steam; and a plurality of discharge holes provided to discharge the steam to the laundry by passing through the heating body.

10. The laundry treating apparatus of claim 9, wherein the supply path further includes at least one spray path along a height direction of the ironing partition body, and the discharge holes are provided along a length direction of the spray path.

11. The laundry treating apparatus of claim 10, further comprising a hanging unit provided in at least any one of an upper portion and a lower portion of the ironing partition unit.

12. The laundry treating apparatus of claim 11, wherein the hanging unit includes:

a hanging body rotatably provided in at least any one of the upper portion and the lower portion of the ironing partition unit to support laundry; and a fixing body coupled to the hanging body to fix the laundry.

13. The laundry treating apparatus of claim 11, wherein the hanging unit includes a first hanging unit rotatably provided at an upper portion of the pressurizing body to fix the laundry, and a second hanging unit rotatably provided at a lower portion of the pressurizing body to fix the laundry, the first hanging unit includes a first hanging body rotatably provided at the upper portion of the pressurizing body to support the laundry, and a first fixing body rotatably provided in the first hanging body to fix the laundry, and the second hanging unit includes a second hanging body rotatably provided at the lower portion of the pressurizing body to support the laundry, and a second fixing body rotatably provided in the second hanging body to fix the laundry.

14. The laundry treating apparatus of claim 13, wherein the second hanging body includes a first through silt into which a first part of the laundry is inserted to pass therethrough, and the second fixing body includes a second through slit into which a second part of the laundry is inserted to pass therethrough.

15. The laundry treating apparatus of claim 13, wherein the first hanging body includes an accommodating groove having one curved surface to allow the laundry to be partially accommodated and supported therein.

16. The laundry treating apparatus of claim 9, further comprising an auxiliary steam supply unit provided in any one of the cabinet, the machine chamber and the door assembly to generate steam, wherein the supply path is provided to communicate the auxiliary steam supply unit with the discharge holes.

17. The laundry treating apparatus of claim 16, wherein the auxiliary steam supply unit includes:

an auxiliary water tank detachably provided in at least any one of the cabinet, the machine chamber and the door assembly to accommodate water;

an auxiliary heater heating water of the auxiliary water tank to generate steam; and a discharge outlet discharging the steam by communicating the auxiliary water tank with the supply path.

18. The laundry treating apparatus of claim 16, wherein the ironing partition unit includes:

a heating body provided to be exposed to the outside in at least any one of both surfaces of the ironing partition body;

a hot wire provided in any one of the ironing partition body and the heating body to heat the heating body; and a supply path provided in any one of the ironing partition body and the heating body to supply steam, and wherein the hot wire is provided along the outside of the supply path and thus prevented from interfering with the supply path.

19. The laundry treating apparatus of claim 18, wherein the door assembly further includes:

a connection hinge rotatably coupling the ironing partition unit with the support body; and a passage unit provided in the connection hinge to allow the hot wire or the supply path to pass therethrough.

20. A laundry treating apparatus comprising:

a cabinet having an opening in a front direction;

a door assembly opening or closing the opening;

a first laundry treating chamber provided inside the cabinet, providing a space for accommodating laundry, and communicated with an outside of the cabinet through the opening; and a machine chamber that is communicated with the first laundry treating chamber and receives at least one of a steam supply unit supplying steam to the first laundry treating chamber and an air supply unit circulating air, wherein the door assembly includes:

a support body supporting the laundry at an inner side of the door assembly, a pressurizing body rotatably provided toward the support body to pressurize the laundry, and an ironing partition unit rotatably provided between the support body and the pressurizing body toward the support body or the pressurizing body to pressurize the laundry at both sides, and wherein the ironing partition unit is configured to communicate with the machine chamber to discharge hot air or moisture supplied from the machine chamber.

* * * * *